US009803455B1

(12) United States Patent
Yang et al.

(10) Patent No.: US 9,803,455 B1
(45) **Date of Patent: *Oct. 31, 2017**

(54) CONSTANT ENTRANCE HOLE PERFORATING GUN SYSTEM AND METHOD

(71) Applicant: GEODynamics, Inc., Millsap, TX (US)

(72) Inventors: Wenbo Yang, Kennedale, TX (US); Philip M Snider, Tomball, TX (US); John T Hardesty, Weatherford, TX (US); David S Wesson, Fort Worth, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/481,702

(22) Filed: Apr. 7, 2017

Related U.S. Application Data

(63) Continuation of application No. 15/352,191, filed on Nov. 15, 2016.

(Continued)

(51) Int. Cl.
*E21B 43/117* (2006.01)
*E21B 43/116* (2006.01)

(Continued)

(52) U.S. Cl.
CPC ..... *E21B 43/117* (2013.01); *E21B 43/119* (2013.01); *F42B 1/028* (2013.01);

(Continued)

(58) Field of Classification Search
CPC ..... E21B 43/116; E21B 43/117; F24B 1/028; F24B 3/08
See application file for complete search history.

(56) References Cited

U.S. PATENT DOCUMENTS 6,393,991 B1 * 5/2002 Funston ..... F42B 1/028 102/306
2014/0076132 A1 * 3/2014 Bird ..... F42B 1/028 89/1.15

(Continued)

OTHER PUBLICATIONS

Halliburton, "Advances in Perforating," Wireline and Perforating, H06064, pp. 1-9, Nov. 2012.

(Continued)

*Primary Examiner* — George Gray
(74) *Attorney, Agent, or Firm* — Sudhakar V. Allada; David W. Carstens; Carstens & Cahoon, LLP

(57) ABSTRACT

A shaped charge comprising a case, a liner positioned within the case, and an explosive filled within the case. The liner is shaped with a subtended angle ranging from 100° to 120° about an apex, a radius, and an aspect ratio such that a jet formed with the explosive creates an entrance hole in a well casing. The jet creates a perforation tunnel in a hydrocarbon formation, wherein a diameter of the jet, a diameter of the entrance hole diameter, and a width and length of the perforation tunnel are substantially constant and unaffected with changes in design and environmental factors such as a thickness and composition of the well casing, position of the charge in the perforating gun, position of the perforating gun in the well casing, a water gap in the wellbore casing, and type of the hydrocarbon formation.

28 Claims, 16 Drawing Sheets

Related U.S. Application Data

(60) Provisional application No. 62/407,896, filed on Oct. 13, 2016.

(51) Int. Cl.

| | |
|---|---|
| ***F42B 1/028*** | (2006.01) |
| ***F42B 3/08*** | (2006.01) |
| ***E21B 43/119*** | (2006.01) |
| *E21B 43/11* | (2006.01) |
| *E21B 43/1185* | (2006.01) |
| *E21B 43/26* | (2006.01) |

(52) U.S. Cl.
CPC ..... *F42B 3/08* (2013.01); *E21B 43/11* (2013.01); *E21B 43/116* (2013.01); *E21B 43/1185* (2013.01); *E21B 43/26* (2013.01)

(56) References Cited

U.S. PATENT DOCUMENTS

| | | | | |
|---|---|---|---|---|
| 2015/0176384 | A1* | 6/2015 | Castillo | E21B 43/26 166/254.2 |
| 2016/0245053 | A1 | 8/2016 | Yang et al. | |
| 2016/0349021 | A1* | 12/2016 | Collier | F42B 1/036 |

OTHER PUBLICATIONS

Hunting, "EQUAfrac® Shaped Charge," Titan Division, Energetics, 2015, www.hunting-intl.com/titan.

IHS Inc., "Step Down Test Analysis," pp. 1-3, 2014, http://www.fekete.com/san/webhelp/welltest/webhelp/Content/HTML_Files/Analysis_Types/Minifrac_Test_Analyses/Step-down_test_analysis.htm.

Satti, Rajani, et al., "A Novel Frac-Optimized Perforating System for Unconventional Wells: Development and Field-Trial," IPS-16-09 Presentation, 2016 International Perforating Symposium Galveston, May 11, 2016, pp. 1-17, Perforators.org, International Perforating Forum.

Sokolove, Chris, et al., "Advancing Consistent Hole Charge Techology to Improve Well Productivity," IPS-16-10 Presentation, 2016 International Perforating Symposium Galveston, May 10, 2016, pp. 1-21, Perforators.org, International Perforating Forum.

Walden, Joel, et al., "Perforating Charges Engineered to Optimize Hydraulic Stimulation Outperform Industry Standard and Reactive Liner Technology," IPS-16-11 Presentation, 2016 International Perforating Symposium Galveston, May 10, 2016, pp. 1-3, Perforators.org, International Perforating Forum.

U.S. Appl. No. 15/352,191, filed Nov. 15, 2016 entitled "Constant Entrance Hole Perforating Gun System and Method." (parent application).

U.S. Appl. No. 15/481,683, filed Apr. 7, 2016 entitled "Constant Entrance Hole Perforating Gun System and Method." (related application).

* cited by examiner

CONSTANT ENTRANCE HOLE PERFORATING GUN SYSTEM AND METHOD

CROSS REFERENCE TO RELATED APPLICATIONS

This is a continuation of application Ser. No. 15/352,191, filed Nov. 15, 2016, which claims the benefit of Provisional Application No. 62/407,896, filed Oct. 13, 2016, the disclosures of which are fully incorporated herein by reference.

FIELD OF THE INVENTION

The present invention relates generally to perforation guns that are used in the oil and gas industry to explosively perforate well casing and underground hydrocarbon bearing formations, and more particularly to an improved apparatus for creating constant entry hole diameter and constant width perforation tunnel.

PRIOR ART AND BACKGROUND OF THE INVENTION

Prior Art Background

During a well completion process, a gun string assembly is positioned in an isolated zone in the wellbore casing. The gun string assembly comprises a plurality of perforating guns coupled to each other either through tandems or subs. The perforating gun is then fired, creating holes through the casing and the cement and into the targeted rock. These perforating holes connect the rock holding the oil and gas and the wellbore. During the completion of an oil and/or gas well, it is common to perforate the hydrocarbon containing formation with explosive charges to allow inflow of hydrocarbons to the wellbore. These charges are loaded in a perforation gun and are typically shaped charges that produce an explosive formed penetrating jet in a chosen direction.

As illustrated in FIG. 1 (0100), a perforating system with 3 clusters, 6 shots or perforations per cluster in a well casing (0120) may be treated with fracturing fluid after perforating with the perforating system. A plug (0110) may be positioned towards a toe end of the well casing to isolate a stage. Cluster (0101) may be positioned towards the toe end, cluster (0103) towards the heel end and cluster (0102) positioned in between cluster (0101) and cluster (0103). Each of the clusters may comprise 3 charges. After a perforating gun system is deployed and the well perforated, entrance holes are created in the well casing and explosives create a jet that penetrates into a hydrocarbon formation. The diameter of the entrance hole further depends on several factors such as the liner in the shaped charge, the explosive type, the thickness and material of the casing, water gap in the casing, centralization of the perforating gun, number of charges in a cluster and number of clusters in a stage. A stage design may further be designed when the size of the entrance hole is determined with a specific set of parameters. Parametric design means changing one thing at a time and evaluating the result. Parameters may be varied on a cluster by cluster, a stage by stage, or a well by well basis. The fixed variables may be fixed, the desired variables changed. The results are evaluated to determine a causality or lack thereof. However if several factors change, results appear to be random, and a conclusion may be drawn to show that the change had no effect. Additionally a stage design depends on the quality of perforation which include the entrance hole size and perforation tunnel shape, length and width. Due to the number of factors that determine the entrance hole size, the variation of the entrance hole diameter (EHD) is large and therefore the design of a stage becomes unpredictable. For example, an entrance hole that is targeted for 0.3 in might have a variation of +−0.15 and the resulting entrance hole diameter might be 0.15 or 0.45 inches. If the entrance hole diameter results in a lower diameter such as 0.15 inches, the resulting treatment may result in unintended and weak fractures in a hydrocarbon formation. Current designs are over designed for larger entrance hole diameters to account for the large variation due to the aforementioned factors affecting the EHD. The significant and unpredictable over design due to variation in EHD results in unpredictable costs, unreliable results and significant costs. Therefore there is a need for a liner design that creates an entrance hole with a diameter that is unaffected by design and environmental factors such as a thickness of the well casing, composition of the well casing, position of a charge in the perforating gun, position of the perforating gun in the well casing, a water gap in the wellbore casing, or type of said hydrocarbon formation. FIG. 1 (0100) illustrates variation in EHD of various charges. For example, EHD (0131) in cluster (0103) is significantly smaller than EHD (0121) in cluster (0102). Similarly the penetration length and width of the perforation tunnel also vary with the aforementioned design and environmental factors. For example, perforation tunnel (0113) in cluster (0103) may be longer than perforation tunnel (0112) in cluster (0102). The large variation in the length and width of the perforation tunnel further causes significant design challenges to effectively treat a hydrocarbon formation. Therefore there is a need to design a shaped charge comprising a liner filled with an explosive such that the resulting variation in the length and the width of perforation tunnel is less than 7.5%.

FIG. 2A (0200) illustrates a chart of entrance hole diameter variation (Y-Axis) for different entrance hole diameters (Y-Axis) versus orientation of the charges (X-Axis). As illustrated in FIG. 2A (0200) the variation of EHD is significant and ranges from 0.05 for a 300 degree orientation charge to 0.32 for a 180 degree oriented charge. The variation of EHD makes a stage design unreliable and unpredictable for pressure and treatment of the stage. According to other studies the variation of EHD is as much as +−50%. Therefore, there is a need for a shaped charge that can reliably and predictably create entrance holes with a variation less than 7.5% irrespective of the several aforementioned design and environmental factors.

FIG. 2B (0220) illustrates a chart of entrance hole diameter variation (Y-Axis) for different entrance hole diameters (Y-Axis) versus orientation of the charges (X-Axis). Pressure drop through an entrance hole can vary as much as the variation in the EHD raised to the power of four. As illustrated in FIG. 2B (0220) the variation of pressure drop is significant and can be as high as 500% for a 180 degree oriented charge. The variation of EHD creates a pressure that is more than designed for treatment of the stage. In some cases the deviation of the pressure drop can be as high as 500%. For example, if the designed pressure drop is 1000 psi at a given pumping rate and if the perforated EHD is smaller than targeted EHD due to the aforementioned factors then the actual pressure drop during treatment could be as high as 10000 psi. Therefore, there is a need for a shaped charge design that can reliably and predictably create entrance holes with a predictable pressure drop at a given rate. There is a need for designing a stage with a pressure variation less than 500 psi between clusters irrespective of the several aforementioned design and environmental factors.

FIG. 3 (0300) illustrates a chart of entrance hole diameter variation (Y-Axis) for different entrance hole diameters (Y-Axis) versus water gap of the charges (X-Axis). As illustrated in FIG. 3 (0300) the variation of EHD is significant and ranges from 2% for a 0.2 inch water gap to 33% for a 1.2 inch water gap. The variation of EHD makes a stage design unreliable and unpredictable for pressure and treatment of the stage. According to other studies the variation of EHD is as much as +−50%. Therefore, there is a need for a shaped charge that can reliably and predictably create entrance holes with a variation less than 7.5% irrespective of the water gap or clearance of the charges with respect to the casing.

Prior Art Stage Design and Perforation Method (0400)

As generally seen in the flow chart of FIG. 4 (0400), a prior art stage design and perforation method with conventional deep penetrating or big hole shaped charges may be generally described in terms of the following steps:

(1) Setting up a plug and isolating a stage in a well casing (0401);

(2) Positioning a perforating gun system with shaped charges and perforate (0402);

(3) Pumping fracture fluid in the stage and manually adjusting pump rate based on the entrance hole diameters and perforation tunnel width and length (0403); and The perforation entrance holes created with conventional charges are prone to unpredictable variation in diameter and perforation tunnel length and diameter. The operator has to increase pump rate in order to inject fluid through the smaller entrance holes. Furthermore, a decentralized gun may create a non-uniform hole size on the top and bottom of the gun. In most cases, operators do not centralize the gun and the pump rate is increased instead.

(4) Completing all stages.

Limited entry fracturing is based on the premise that every perforation will be in communication with a hydraulic fracture and will be contributing fluid during the treatment at the pre-determined rate. Therefore, if any perforation does not participate, then the incremental rate per perforation of every other perforation is increased, resulting in higher perforation friction. By design, each perforation in limited entry is expected to be involved in the treatment. Currently, 2 to 4 perforation holes per cluster, and 1 to 8 clusters per stage are shot so that during fracturing treatment fluid is limited to the cluster at the heel end and the rest is diverted to the downstream (toe end) clusters. Some of the perforation tunnels with smaller EHD's than intended EHD cause energy and pressure loss during fracturing treatment which reduces the intended pressure in the fracture tunnels. For example, if a 100 bpm fracture fluid is pumped into each stage at 10000 psi with an intention to fracture each perforation tunnel at 2-3 bpm, most of the energy is lost in ineffective fractures due to smaller EHD and higher tortuosity thereby reducing the injection rate per fracture to substantially less than 2-3 bpm. The more energy put through each perforation tunnel, the more fluid travels through the fracture tunnel, the further the fracture extends. Most designs currently use unlimited stage entry to circumvent the issue of EHD variations in limited entry. However, unlimited entry designs are ineffective and mostly time expensive. In unlimited entry when one fracture takes up fracture fluid it will take up most of the fluid while the other tunnels are deprived of the fluid. Limited entry limits the fluid entry into each cluster by limiting the number of perforations per cluster, typically 2-3 per cluster. Therefore, there is a need for creating entrance holes with minimum variation of EHD (less than 7.5%) within a cluster and between clusters so that each of the clusters in the limited entry state contribute substantially equally during fracture treatment.

Some of the techniques currently used in the art for diverting fracture fluid include adding sealants such as ball sealers, solid sealers or chemical sealers that plug perforation tunnels so as to limit the flow rate through the heelward cluster and divert the fluid towards toeward clusters. However, if the EHD's and penetration depths of tunnels in the clusters have a wide variation, each of the clusters behave differently and the flow rate in each of the clusters is not controlled and not equal. Therefore, there is a need for more equal entry (EHD) design that allows for a precise design for effective diversion. There is also a need for a method that distributes fluid substantially equally among various clusters in a limited entry stage.

Publications such as "Advancing Consistent Hole Charge Technology to Improve Well Productivity" ("IPS-10") in INTERNATIONAL PERFORATING SYMPOSIUM GALVESTON disclose shaped charges that create consistent entrance holes. IPS-10 discloses a jet in slide 4 that illustrates a contrast of conventional shaped jet versus a jet created by consistent hole technology at a tail end of the jet. However, a constant jet at the tail end of a jet would not create constant diameter and width perforation tunnel. Therefore, there is a need for a constant diameter jet (extended portion) between a tail end and a tip end of the jet so that a constant diameter perforation tunnel is created along with a constant diameter entrance hole. IPS-10 also discloses a table in slide 16 illustrating a variation of entrance hole diameters for different companies, gun diameters, casing diameters and charges. Company A creates a hole size of 0.44 inches with a variation of 5.9% with a 3⅜ inch gun size, 5½ inch casing; creates a hole size of 0.38 inches with a variation of 4.9% with a different charge. However, company A clearly demonstrates a different hole size (0.44 inches vs. 0.38 inches) with identical gun size and casing size. There is a need for creating an entrance hole with diameter that is unaffected by changes in the casing size or the gun size.

Publications such as "Perforating Charges Engineered to Optimize Hydraulic Stimulation Outperform Industry Standard and Reactive Liner Technology" ("IPS-11") in INTERNATIONAL PERFORATING SYMPOSIUM GALVESTON teach low variability entrance holes (slide 5). However, the low variability is not associated with a wide subtended angle liner in a charge. IPS-11 does not teach a constant diameter and length penetrating jet along with a constant diameter entrance hole.

Hunting discloses (www.hunting-intl.com/titan) an EQUAfrac® Shaped Charge that reduces variation in entry holes diameters. According to the specifications of the flyer, the variation of the charges for entrance hole diameters 0.40 inches and 0.38 inches are 2.5% and 4.9%. However, the penetration depth variation is quite large. Furthermore, EQUAfrac® Shaped Charge does not teach a subtended angle of liner greater than 90 degrees. EQUAfrac® Shaped Charge does not teach a jet that can produce a constant diameter jet that creates a perforation tunnel with a constant diameter, length and width irrespective of design and environmental factors.

Typically deep penetrating charges are designed with a 40-60 degree conical liner. Big hole charges typically comprise a liner with a parabolic or a hemispherical shape. The angle in the big hole ranges from 70-90 degrees. However, current art does not disclose charges that comprise liners with greater than 90 degree subtended angle. The jet formed by the deep penetrating and big hole charge is typically not constant and a tip portion gets consumed in a water gap in the casing when a gun is decentralized. Operators in the field cannot centralize a gun and therefore after perforation step, the diameter of the entrance hole at the bottom is much greater than the diameter of the hole in the top. A portion of the tip of the jet is generally consumed in the water gap leaving a thin portion of the jet to create an entrance hole. Furthermore, the diameter and width of the jet may not be constant and therefore a perforation tunnel is created with an unpredictable diameter, length and width. Therefore, there is a need for creating equal diameter entrance holes in the top and bottom of a casing irrespective of the size of the water gap, the thickness of the casing and the composition of the casing. There is also a need for creating a constant diameter jet that creates a perforation tunnel with a constant diameter, width and length irrespective of the design and environmental factors such as casing diameter, gun diameter, a thickness of the well casing, composition of the well casing, position of the charge in the perforating gun, position of the perforating gun in the well casing, a water gap in the wellbore casing, or type of the hydrocarbon formation.

A step down rate test is typically used to pump fluid at various pump rates and record pressure at each of the rate. This type of analysis is performed prior to a main frac job. It is used to quantify perforation and near-wellbore pressure losses (caused by tortuosity) of fractured wells, and as a result, provides information pertinent to the design and execution of the main frac treatments. Step-down tests can be performed during the shut-down sequence of a fracture calibration test. To perform this test, a fluid of known properties (for example, water) is injected into the formation at a rate high enough to initiate a small frac. The injection rate is then reduced in a stair-step fashion, each rate lasting an equal time interval, before the well is finally shut-in. The resulting pressure response caused by the rate changes is influenced by perforation and near-wellbore friction. Tortuosity and perforation friction pressure losses vary differently with rate. By analyzing the pressure losses experienced at different rates, we can differentiate between pressure losses due to tortuosity and due to perforation friction.

Pressure drops across perforations and due to tortuosity are given mathematically by the following equations:

$$\Delta p_{perf} = k_{perf} q^2 \text{ where } k_{perf} = \frac{1.975\gamma_{inj}}{C_d^2 n_{perf}^2 d_{perf}^4}$$

$$\Delta p_{tort} = k_{tort} q^{\alpha}$$

$\Delta p_{perf}$ Perforation pressure loss, psi
$\Delta p_{tort}$ Tortuosity pressure loss, psi
q Flow rate. stb/d
$k_{perf}$ Perforation pressure loss coefficient, psi/(stb/d)$^2$
$k_{tort}$ Tortuosity pressure loss coefficient, psi/(stb/d)$^2$
$\gamma_{inj}$ Specific gravity of injected fluid
$C_d$ Discharge coefficient
$n_{perf}$ Number of perforations
$d_{perf}$ Diameter of perforation, in
$\alpha$ Tortuosity pressure loss exponent, usually 0.5

For step-down tests, it is essential to keep as many variables controlled as possible, so that the pressure response during the rate changes is due largely to perforations and tortuosity, and not some other factors. When the injection rate is changed, the pressure does not change in a stair-step fashion; it takes some time for pressure to stabilize after a change in rate. To make sure the effect of this pressure transition does not obscure the relationship between the injection rate and pressure, injection periods of the same duration are used. From the equations aforementioned, one of key contributors to the perforation pressure loss is the diameter of the perforation hole. A large variation in the diameter of the perforation causes a large variation in the perforation loss component. Therefore, there is a need to fix the perforation hole diameter within a variation of 7.5% inches such the overall pressure loss is attributable to the tortuosity and provides a measure of the tortuosity near the wellbore.

Deficiencies in the Prior Art

The prior art as detailed above suffers from the following deficiencies:

- Prior art systems do not provide for a shaped charge that can reliably and predictably create entrance holes with a variation less than 7.5% irrespective of the several aforementioned design and environmental factors.
- Prior art methods do not provide for designing a shaped charge comprising a liner filled with an explosive such that the resulting variation in the length and the width of perforation tunnel is minimal.
- Prior art methods do not provide for designing a stage with a pressure variation less than 500 psi between clusters irrespective of the several aforementioned design and environmental factors.
- Prior art methods do not provide for creating entrance holes with minimum variation of EHD (less than 7.5%) within a cluster and between clusters so that each of the clusters in the limited entry state contribute substantially equally during fracture treatment.
- Prior art methods do not provide for more equal entry (EHD) design that allows for a precise design for effective diversion. There is also a need for a method that distributes fluid substantially equally among various clusters in a limited entry stage.
- Prior art methods do not provide a shaped charge capable of creating constant EHD's so that the tortuosity near a wellbore can be determined or modelled.
- Prior art methods do not provide a step down rate test with a controlled and predictable pressure loss due to perforation hole.
- Prior art charges do not provide for a constant diameter jet (extended portion) between a tail end and a tip end of the jet so that a constant diameter, constant length perforation tunnel is created along with a constant diameter entrance hole and unaffected by design and environmental factors such as casing diameter, gun diameter, a thickness of the well casing, composition of the well casing, position of the charge in the perforating gun, position of the perforating gun in the well casing, a water gap in the wellbore casing, or type of the hydrocarbon formation.

While some of the prior art may teach some solutions to several of these problems, the core issue of creating constant hole diameter entrance hole with a variation less than 7.5% has not been addressed by prior art.

BRIEF SUMMARY OF THE INVENTION

System Overview

The present invention in various embodiments addresses one or more of the above objectives in the following manner. The present invention provides a shaped charge for use in a perforating gun is disclosed. The charge comprises a case, a liner positioned within the case, and an explosive filled within the case. The liner is shaped with a subtended angle about an apex, a radius, and an aspect ratio such that a jet formed with the explosive creates an entrance hole in a well casing. The subtended angle of the liner ranges from 100° to 120°. The jet creates a perforation tunnel in a hydrocarbon formation, wherein a diameter of the jet, a diameter of the entrance hole diameter, and a width and length of the perforation tunnel are substantially constant and unaffected with changes in design and environmental factors such as a thickness and composition of the well casing, position of the charge in the perforating gun, position of the perforating gun in the well casing, a water gap in the wellbore casing, and type of the hydrocarbon formation.

Method Overview

The present invention system may be utilized in the context of an overall perforating method with shaped charges in a perforating system, wherein the shaped charges as described previously is controlled by a method having the following steps:

(1) setting up a plug and isolating a stage;
(2) targeting an entrance hole diameter of the entrance hole;
(3) selecting an explosive load, a subtended angle, a radius and an aspect ratio for each of the plurality of charges;
(4) positioning the system along with the plurality of charges in the well casing;
(5) perforating with the plurality of charges into a hydrocarbon formation;
(6) creating the entrance hole with the entrance hole diameter and completing the stage; and
(7) pumping fracture treatment in the stage at a designed rate without substantially adjusting pumping rate.

Integration of this and other preferred exemplary embodiment methods in conjunction with a variety of preferred exemplary embodiment systems described herein in anticipation by the overall scope of the present invention.

BRIEF DESCRIPTION OF THE DRAWINGS

For a fuller understanding of the advantages provided by the invention, reference should be made to the following detailed description together with the accompanying drawings wherein.

DESCRIPTION OF THE PRESENTLY PREFERRED EXEMPLARY EMBODIMENTS

Figure 1:
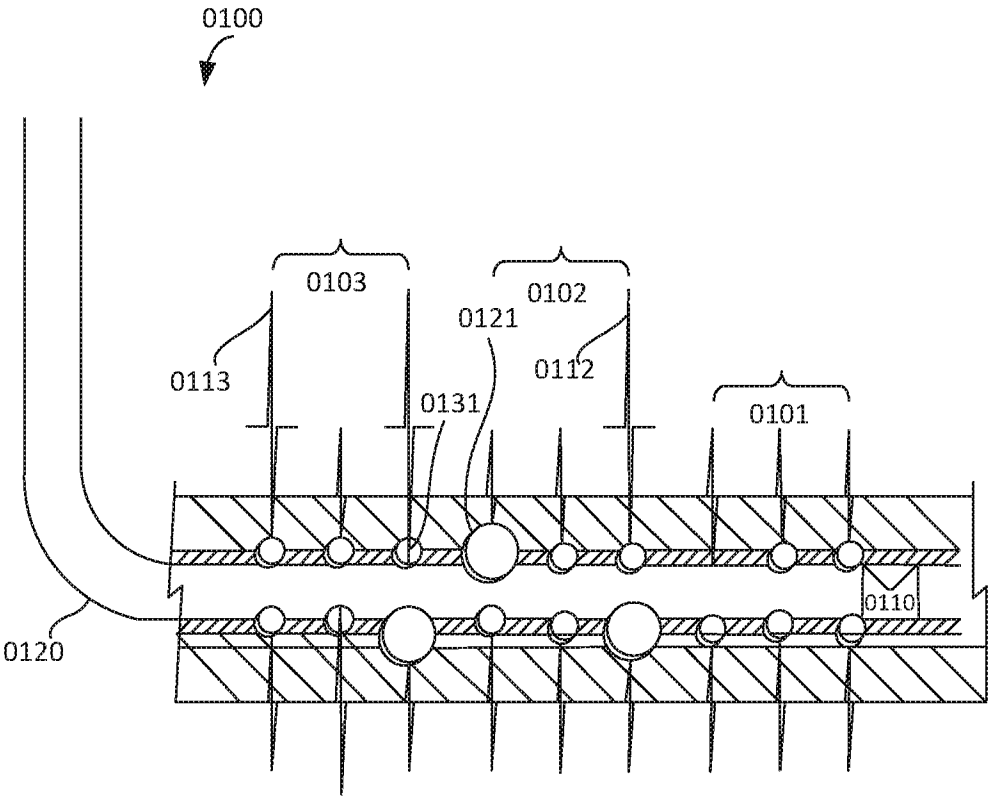
FIG.1 Prior Art
FIG. 1 is a prior art perforating gun system in a well casing.

While this invention is susceptible of embodiment in many different forms, there is shown in the drawings and will herein be described in detailed preferred embodiment of the invention with the understanding that the present disclosure is to be considered as an exemplification of the principles of the invention and is not intended to limit the broad aspect of the invention to the embodiment illustrated.

The numerous innovative teachings of the present application will be described with particular reference to the presently preferred embodiment, wherein these innovative teachings are advantageously applied to the particular problems of creating constant diameter entrance holes and constant diameter and length perforation tunnels. However, it should be understood that this embodiment is only one example of the many advantageous uses of the innovative teachings herein. In general, statements made in the specification of the present application do not necessarily limit any of the various claimed inventions. Moreover, some statements may apply to some inventive features but not to others.

OBJECTIVES OF THE INVENTION

Accordingly, the objectives of the present invention are (among others) to circumvent the deficiencies in the prior art and affect the following objectives:

- Provide for a shaped charge that can reliably and predictably create entrance holes with a variation less than 7.5% irrespective of the several aforementioned design and environmental factors.
- Provide for designing a shaped charge comprising a liner filled with an explosive such that the resulting variation in the length and the width of perforation tunnel is minimal.
- Provide for designing a stage with a pressure variation less than 500 psi between clusters irrespective of the several aforementioned design and environmental factors.
- Provide for creating entrance holes with minimum variation of EHD (less than 0.05 inches) within a cluster and between clusters so that each of the clusters in the limited entry state contribute substantially equally during fracture treatment.
- Provide for more equal entry (EHD) design that allows for a precise design for effective diversion. There is also a need for a method that distributes fluid substantially equally among various clusters in a limited entry stage.
- Provide a shaped charge capable of creating constant EHD's so that the tortuosity near a wellbore can be determined or modelled.
- Provide a step down rate test with a controlled and predictable pressure loss due to perforation hole.
- Provide for a constant diameter jet (extended portion) between a tail end and a tip end of the jet so that a constant diameter, constant length perforation tunnel is created along with a constant diameter entrance hole and unaffected by design and environmental factors such as casing diameter, gun diameter, a thickness of the well casing, composition of the well casing, position of the charge in the perforating gun, position of the perforating gun in the well casing, a water gap in the wellbore casing, or type of the hydrocarbon formation.

While these objectives should not be understood to limit the teachings of the present invention, in general these objectives are achieved in part or in whole by the disclosed invention that is discussed in the following sections. One skilled in the art will no doubt be able to select aspects of the present invention as disclosed to affect any combination of the objectives described above.

Preferred Exemplary System Shaped Charge and Perforating Jet

After a stage has been isolated for perforation, a perforating gun string assembly (GSA) may be deployed and positioned in the isolated stage. The GSA may include a string of perforating guns such as gun mechanically coupled to each other through tandems or subs or transfers. After a GSA is pumped into the wellbore casing, the GSA may be decentralized on the bottom surface of the casing due to gravity. The GSA may orient itself such that a plurality of charges inside a charge holder tube (CHT) are angularly oriented or not. The plurality of shaped charges in the gun together may herein be referred to as "cluster". The charges may be oriented with a metal strip. The perforating guns may be centralized or decentralized in the casing. According to a preferred exemplary embodiment the thickness of the well casing ranges from 0.20 to 0.75 inches. According to another preferred exemplary embodiment the diameter of the well casing ranges from 3 to 12 inches. According to a more preferred exemplary embodiment the diameter of the well casing ranges from 4 to 6 inches.

Figure 5A:
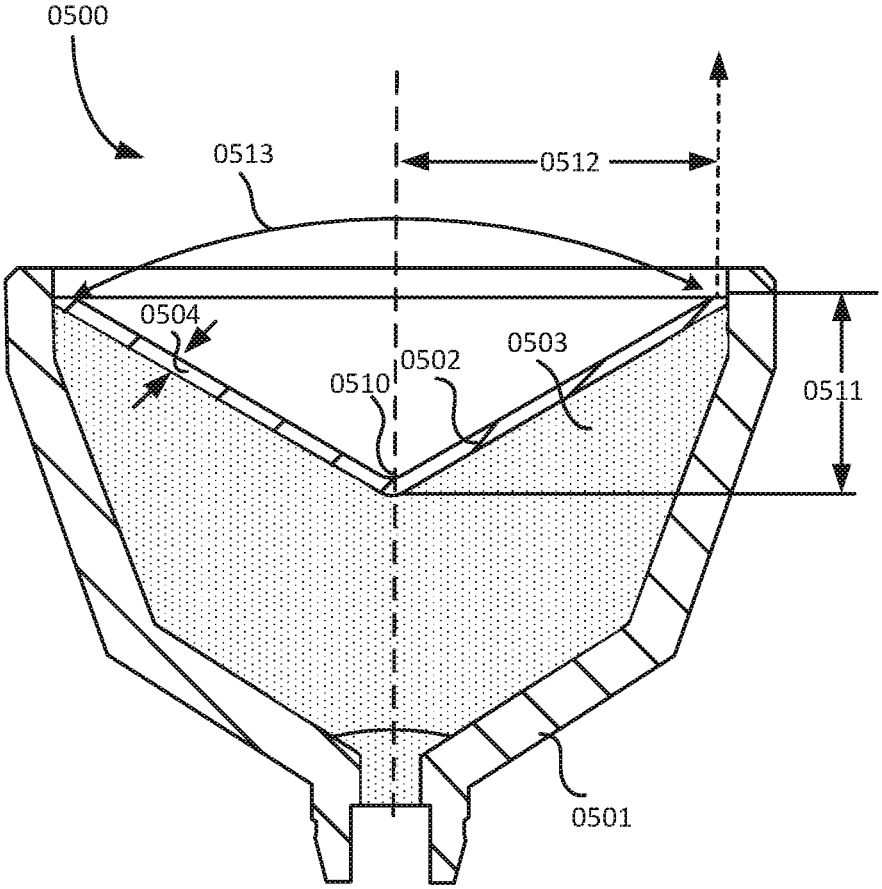
FIG. 5A is an exemplary side view of a shaped charge with a liner suitable for use in some preferred embodiments of the invention.
Figure 5B:
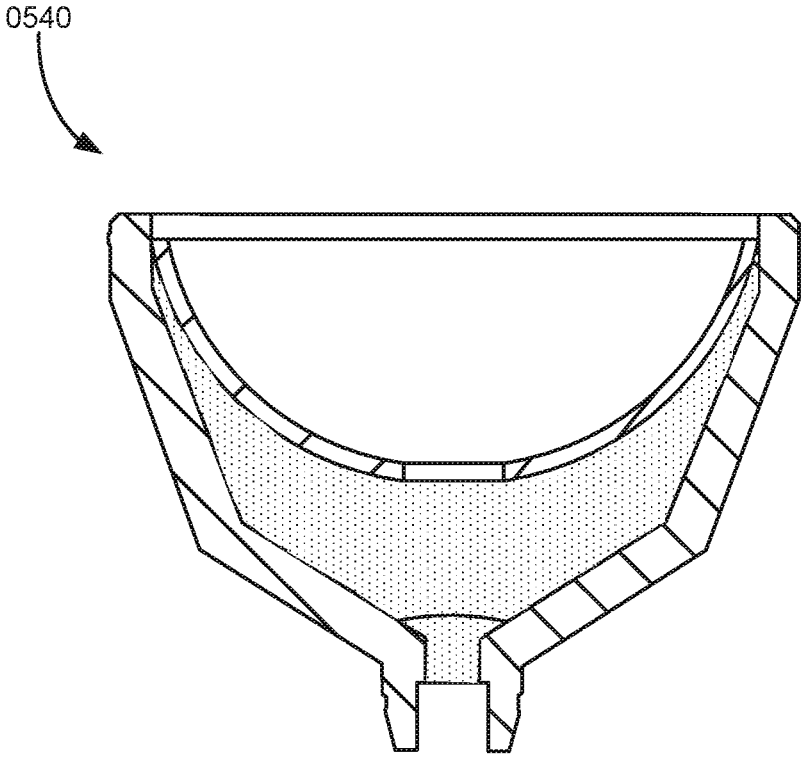
FIG. 5B is an exemplary side view of a big hole shaped charge with a liner suitable for use in some preferred embodiments of the invention.

FIG. 5A generally illustrates a cross section of an exemplary shaped charge (0500) comprising a case (0501), a liner (0502) positioned within the case (0501), and an explosive (0503) filled between the liner (0502) and the case (0501). FIG. 5B generally illustrates a cross section of an exemplary big hole shaped charge (0540) comprising a case, a liner positioned within the case, and an explosive filled between the liner and the case. According to a preferred exemplary embodiment, the thickness (0504) of the liner (0502) may be constant or variable. The thickness of the liner may range from 0.01 inches to 0.2 inches. The shaped charge may be positioned with a charge holder tube (not shown) of a perforating gun (not shown). According to a preferred exemplary embodiment the charge is a reactive or conventional charge. According to a preferred exemplary embodiment the diameter of the perforating gun ranges from 1 to 7 inches. According to another preferred exemplary embodiment the position of the charge in the perforating gun is oriented in an upward direction. According to yet another preferred exemplary embodiment the position of the charge in the perforating gun is oriented in a downward direction. The liner may be shaped with a subtended angle (0513) about an apex (0510) of the liner (0502). The apex (0510) of the liner may be an intersecting point and the subtended angle (0513) may be an angle subtended about the apex (0510). The liner shape may have a radius (0512) and a height (0511). According to a preferred exemplary embodiment the radius of the liner ranges from 0.01 to 0.5 inches. An aspect ratio of the liner may be defined as a ratio of the radius (0512) to the height (0511) of the liner (0502). According to a preferred exemplary embodiment the aspect ratio of the liner ranges from 1 to 10. According to a more preferred exemplary embodiment the aspect ratio of the liner ranges from 2 to 5. According to a most preferred exemplary embodiment the aspect ratio of the liner ranges from 3 to 4. The aspect ratio, subtended angle (0513) and a load of explosive are selected such that a jet formed with the explosive creates an entrance hole in a well casing. The jet creates a perforation tunnel in a hydrocarbon formation after penetrating through a casing. The casing may be cemented or not. The jet may also penetrate a water gap within the casing. The diameter of the jet, a diameter of the entrance hole, and a width and length of the perforation tunnel are substantially constant and unaffected with changes in design and environmental factors. The design and environmental factors are selected from a group comprising of: a casing diameter, a gun diameter, a thickness of the well casing, composition of the well casing, position of the charge in the perforating gun, position of the perforating gun in the well casing, a water gap in the wellbore casing, type of said hydrocarbon formation, or a combination thereof. If a shaped charge is designed to create a 0.35 inch entrance hole diameter (0.35 EHD) or a 0.40 inch entrance hole diameter (0.40 EHD), the aspect ratio, subtended angle, and/or an explosive load weight is selected for each shaped charge depending on the entrance hole diameter. According to a preferred exemplary embodiment the diameter of the entrance hole in the well casing ranges from 0.15 to 0.75 inches. The 0.35 EHD charge creates an entrance hole in a casing with a substantially constant 0.35 inch diameter and the 0.40 charge creates an entrance hole in a casing with a substantially constant 0.40 inch diameter regardless of changes in the aforementioned design and environmental factors. It should be noted that the term "water gap" used herein is a difference of the outside diameter of a perforating gun and the inside diameter of a casing. According to a preferred exemplary embodiment said thickness of said water gap (diff ranges from 0.15 to 2.5 inches. For example, if the perforating gun with a 3½, inch outside diameter is decentralized and lays at the bottom of a casing with an inside diameter of 5/2 inches, the water gap is 2 inches. In some instances, if the water gap changes from 1 inches to 4 inches or thickness of the casing changes from 0.6 inches to 1 inch, the 0.35 EHD charge may create an entrance hole that has a diameter that ranges from 0.32375 to 0.37625 inches for both the water gaps or in other words the variation is less than 7.5%. Similarly, the 0.40 EHD charge will create a 0.40 in diameter entrance hole for both the water gaps and both the thicknesses of the casing with a variation less than 7.5%. The variation of the EHD 7.5% and the variation of the perforation length is less than 5% for perforating into any hydrocarbon formation. According to a preferred exemplary embodiment the type of the hydrocarbon formation is selected from a group comprising: shale, carbonate, sandstone or clay.

Figure 2A:
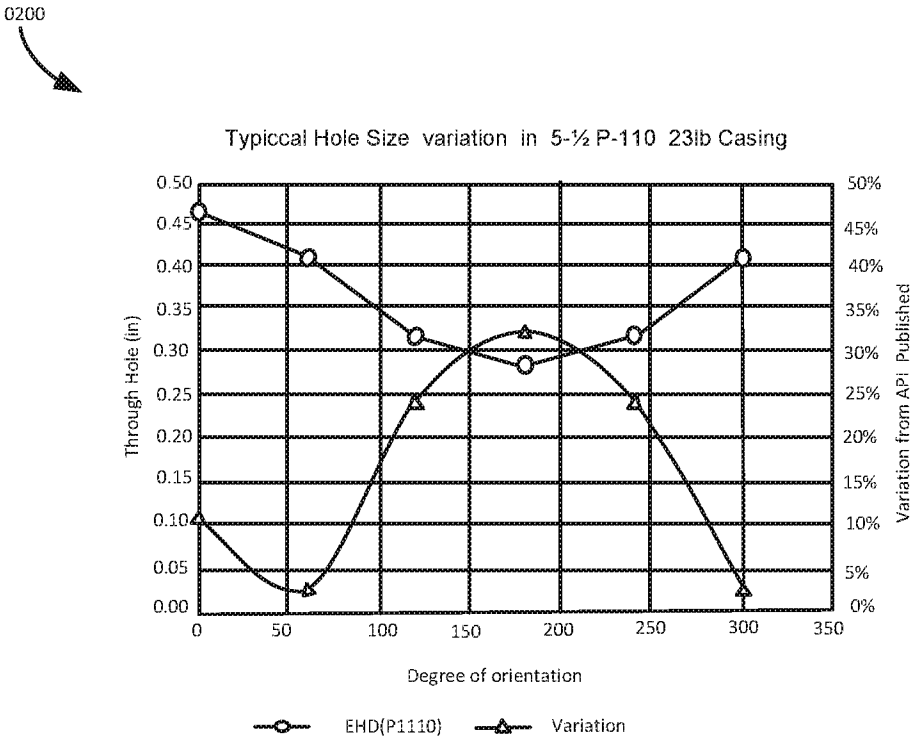
FIG.2A Prior Art
FIG. 2A is a prior art chart of entrance hole diameter variation (Y-Axis) for different entrance hole diameters (Y-Axis) versus orientation of the charges (X-Axis).
Figure 6:
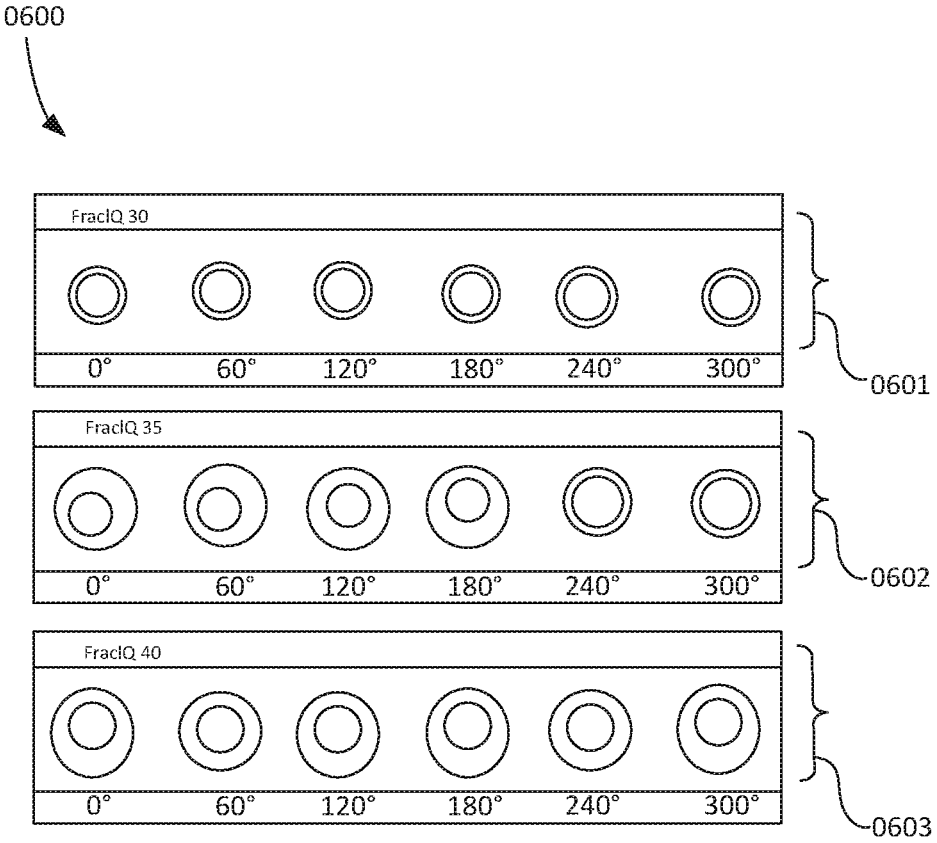
FIG. 6 is an illustration of entrance holes with substantially equal diameters and created by exemplary shaped charges according to a preferred embodiment of the present invention.
Figure 7A:
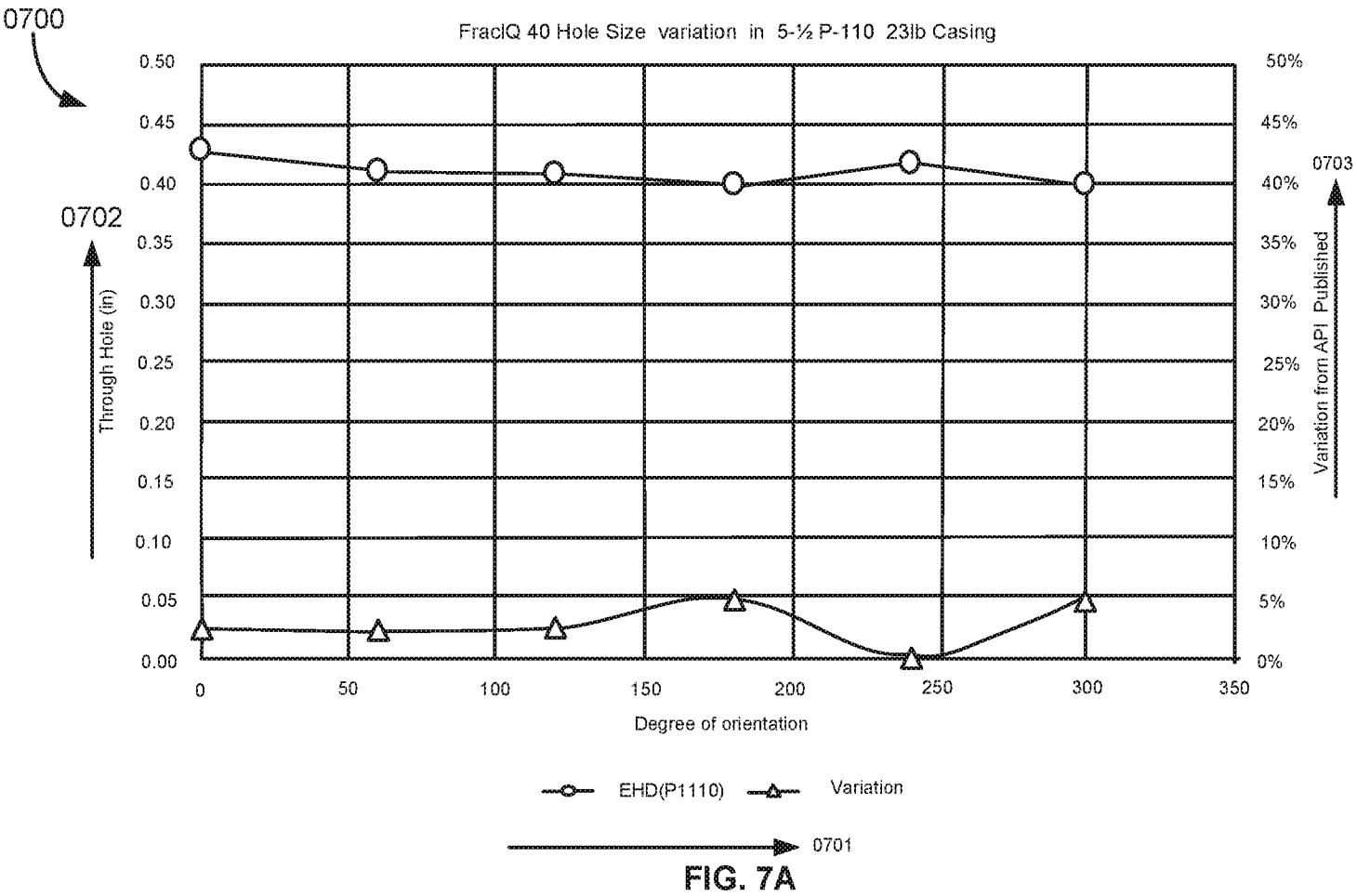
FIG. 7A is an exemplary chart of entrance hole diameter variation (Y-Axis) for different entrance hole diameters (Y-Axis) versus orientation of the charges (X-Axis) as created by some exemplary charges of the present invention.

FIG. 6 (0600) generally illustrates entrance holes for 0.30 EHD charges (0601), 0.35 EHD charges (0602) and 0.40 EHD charges (0603). The entrance holes of each of the charges are illustrated for phasing of 0°, 60°, 120°, 180°, 240°, 300°, and 360°. The variation of 0.30 EHD charges (0601), 0.35 EHD charges (0602) and 0.40 EHD charges (0603) at the various phasing is less than 7.5% and in most cases less than 5%. FIG. 7A (0700) generally illustrates an exemplary flow chart of a 0.40 EHD charge in a 5½ inch casing. The chart shows the entrance hole diameters (0702) on the Y-Axis for different phasing on the X-Axis (0701). Additionally, a variation of the entrance hole diameters (0703) as a percentage is generally illustrated on the Y-Axis for different phasing on the X-Axis (0701). As illustrated the variation of EHD for the 0.40 EHD charge is less than 5% for all the different phasing's. It should be noted the variation is unaffected by variation in water gaps in the casing. Similar charts of 0.30 EHD charge (not shown), 0.35 EHD charge (not shown) and other EHD charges (not shown) illustrate a variation in EHD of less than 5%. The variation of EHD created by prior art charges as illustrated in FIG. 2A (0200) is more than 3000.

Figure 2B:
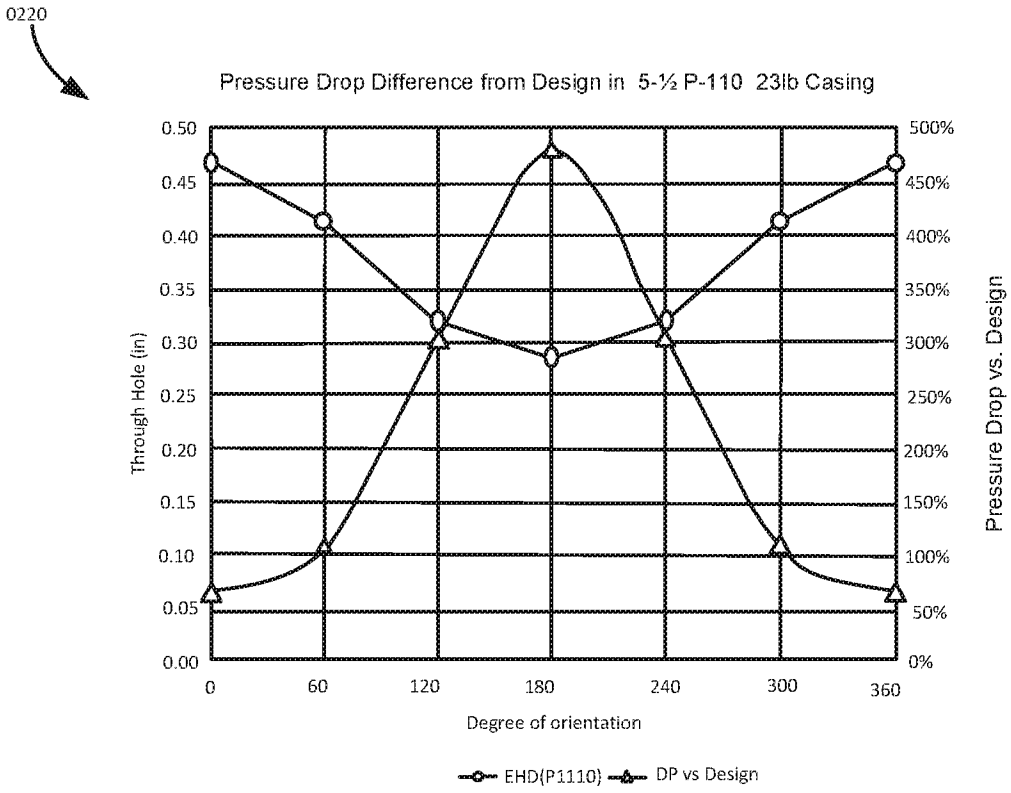
FIG.2B Prior Art
FIG. 2B is a prior art chart of entrance hole diameter variation (Y-Axis) for different entrance hole diameters (Y-Axis) versus orientation of the charges (X-Axis).
Figure 7B:
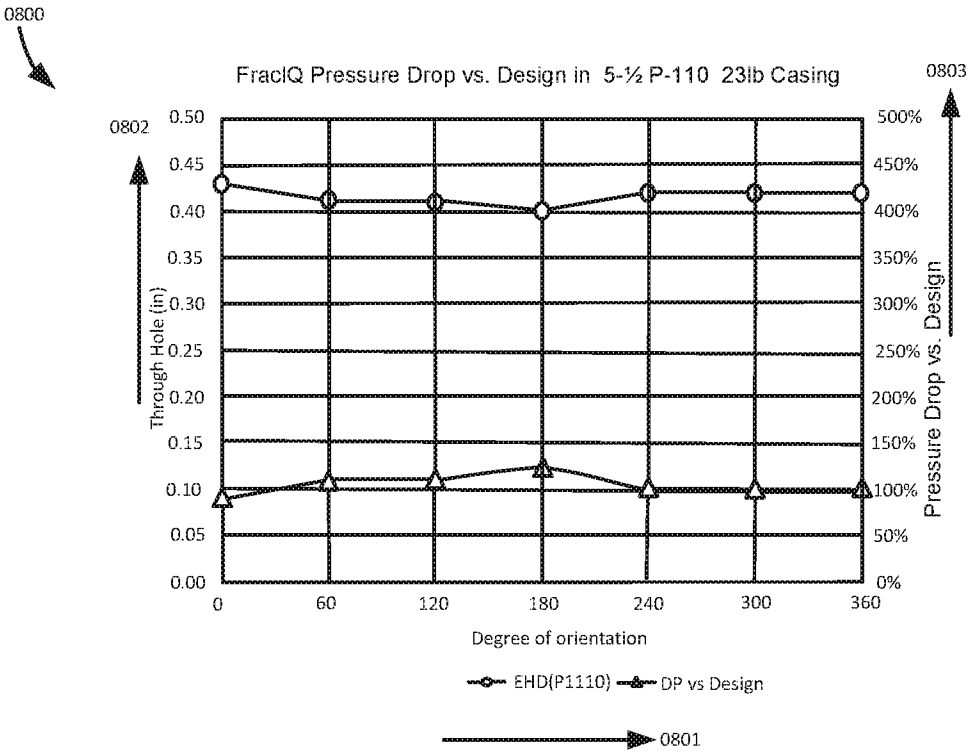
FIG. 7B is an exemplary chart of entrance hole diameter variation (Y-Axis) for different entrance hole diameters (Y-Axis) versus orientation of the charges (X-Axis) as created by some exemplary charges of the present invention.

FIG. 7B (0800) generally illustrates an exemplary flow chart of a 0.40 EHD charge in a 5½ inch casing. The chart shows the entrance hole diameters (0802) on the Y-Axis for different phasing (degree of orientation) on the X-Axis (0801). Additionally, a variation of the pressure (0803) as a percentage of designed pressure is generally illustrated on the Y-Axis for different phasing on the X-Axis (0801). As illustrated the variation of pressure drop for the 0.40 EHD charge is less than 100% for all the different phasing's. It should be noted the variation of pressure is unaffected by variation in water gaps in the casing. For example, the pressure drop may be less than 1000 psi for a designed pressure of 500 psi. The amount of pressure required to inject fluid at a given rate varies as the fourth power of EHD of the holes and may be directly proportional to the variation of the penetration length of the tunnel. According to an exemplary embodiment, an exemplary shaped charge is configured with a subtended angle, explosive weight such that a jet created from the shaped charge creates a substantially constant diameter entrance hole and a substantially constant penetration depth and diameter of the perforation tunnel in a hydrocarbon formation. The variation of pressure drop by prior art charges as illustrated in FIG. 2B (0220) is more than 450%.

Figure 3:
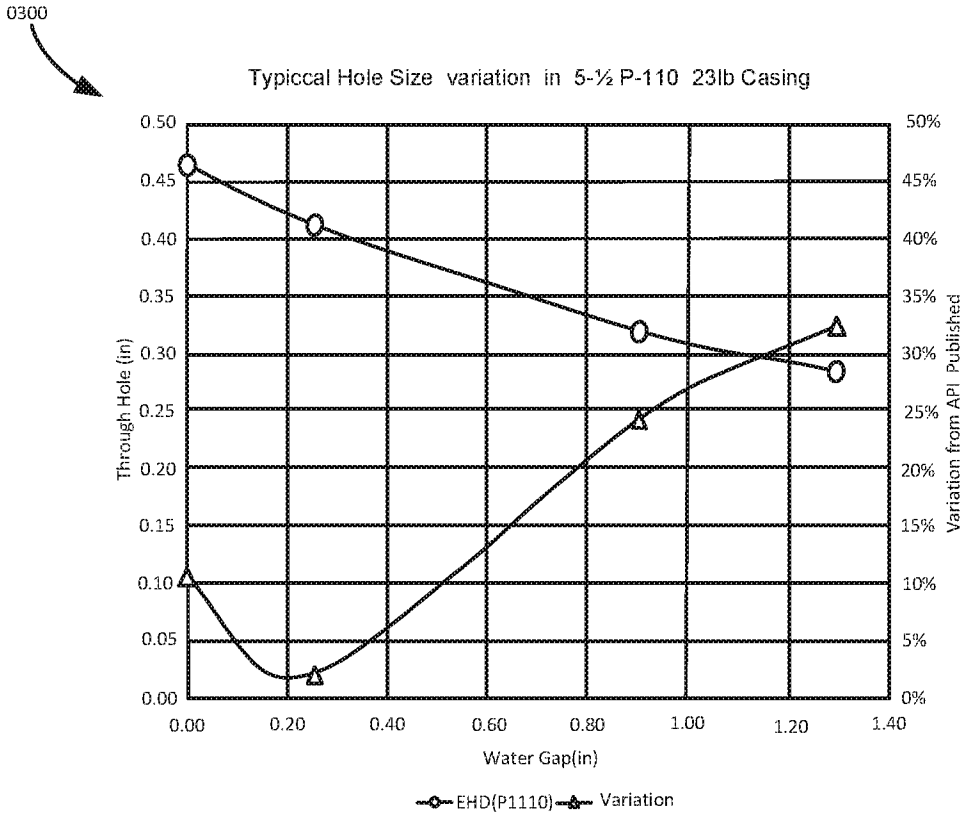
FIG.3 Prior Art
FIG. 3 is a prior art chart of entrance hole diameter variation (Y-Axis) for different entrance hole diameters (Y-Axis) versus water gap or clearance (X-Axis).
Figure 4:
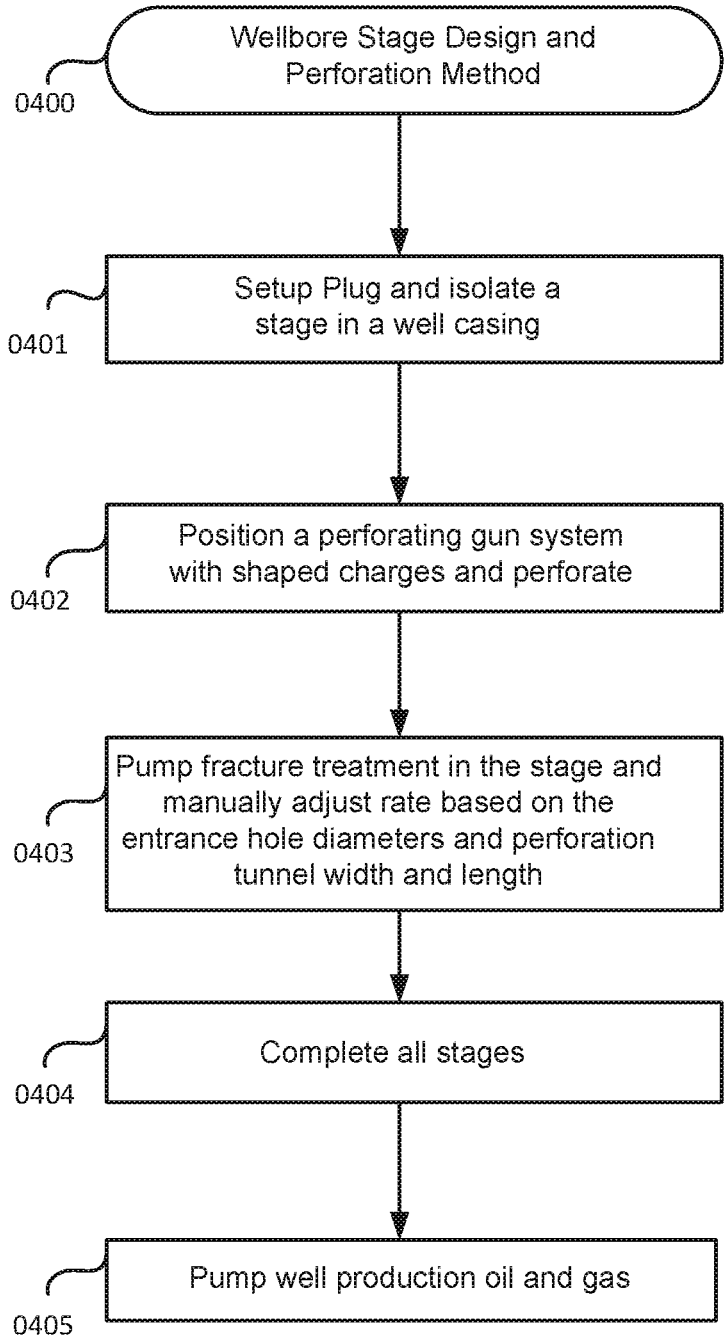
FIG.4 Prior Art
FIG. 4 is a prior art wellbore stage design method.
Figure 8:
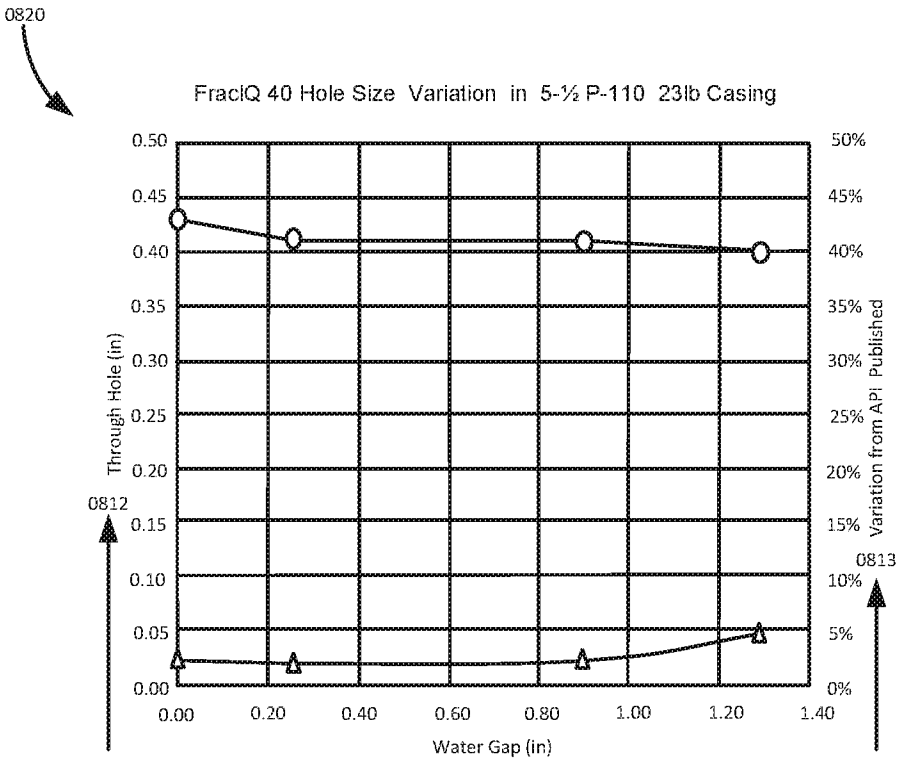
FIG. 8 is an exemplary chart of entrance hole diameter variation (Y-Axis) for different entrance hole diameters (Y-Axis) versus water gap of the charges (X-Axis) as created by some exemplary charges of the present invention.

FIG. 8 (0820) generally illustrates an exemplary flow chart of a 0.40 EHD charge in a 5½ inch casing. The chart shows the entrance hole diameters (0812) on the Y-Axis for water gaps on the X-Axis (0811). Additionally, a variation of the entrance hole diameters (0813) as a percentage is generally illustrated on the Y-Axis for different water gap clearances on the X-Axis (0811). As illustrated the variation of EHD for the 0.40 EHD charge is less than 5% for all the different water gaps. It should be noted the variation is unaffected by variation in phasing of the charges in the casing. Similar charts of 0.30 EHD charge (not shown), 0.35 EHD charge (not shown) and other EHD charges (not shown) illustrate a variation in EHD of less than 5%. The variation of EHD created by prior art charges as illustrated in FIG. 3 (0300) is more than 30%. For example, for a water gap of 1.2 inches, prior art charges show a variation of 33% versus 4.9% variation created by exemplary charges illustrated in FIG. 5A (0500) and FIG. 5B (0540).

As shown below in Table 1.0, the 0.30 EHD charge, 0.35 EHD charge and the 0.40 EHD charge create entrance holes corresponding to 0.30 in, 0.35 in and 0.40 in with a variation of 3.8%, 3.0% and 3.8% respectively. According to a preferred exemplary embodiment, the variation ((maximum diameter−minimum diameter/average diameter)*100) of the entrance hole diameters is less than 7.5%. In other cases, the variation is less than 0.02 inches of the target EHD. Additionally, each of the charges create a penetration length of 7 inches irrespective of the other factors indicated such as gun outer diameter, shot density and phasing, entry hole diameter, and casing diameter. It should be noted that several other factors such as aforementioned design and environmental factors do not impact the penetration length and diameter of the perforation tunnel. While prior art such as aforementioned IPS-10 and IPS-11 illustrate low variability, the variability of penetration length of the perforation tunnel is not shown. Preferred embodiments as illustrated in TABLE 1.0 illustrate a variation of less than 5% for entrance hole diameters and a substantially constant penetration length irrespective of other factors such as aforementioned design and environmental factors. According to a preferred exemplary embodiment the length of said perforation tunnel in the hydrocarbon formation ranges from 1 to 20 inches. According to another preferred exemplary embodiment a variation of the length of the perforation tunnel in the hydrocarbon formation is less than 20%. According to yet another preferred exemplary embodiment a variation of the width of the perforation tunnel in the hydrocarbon formation range is less than 5%. The variation of the width of the tunnel may range from 2% to 10%. For example, for a 6 inch length tunnel the length of the tunnel may range from 4.8-7.2 inches or +−1.2. According to yet another a preferred exemplary embodiment the width of said perforation tunnel in said hydrocarbon formation ranges from 0.15 to 1 inches. The subtended angle of the liner may be selected to create a constant diameter jet which in turn creates a constant diameter, length and width of the perforation tunnel. A constant diameter jet enables a substantially constant diameter entrance hole on the top and bottom of the casing irrespective of the water gap.

Figure 9:
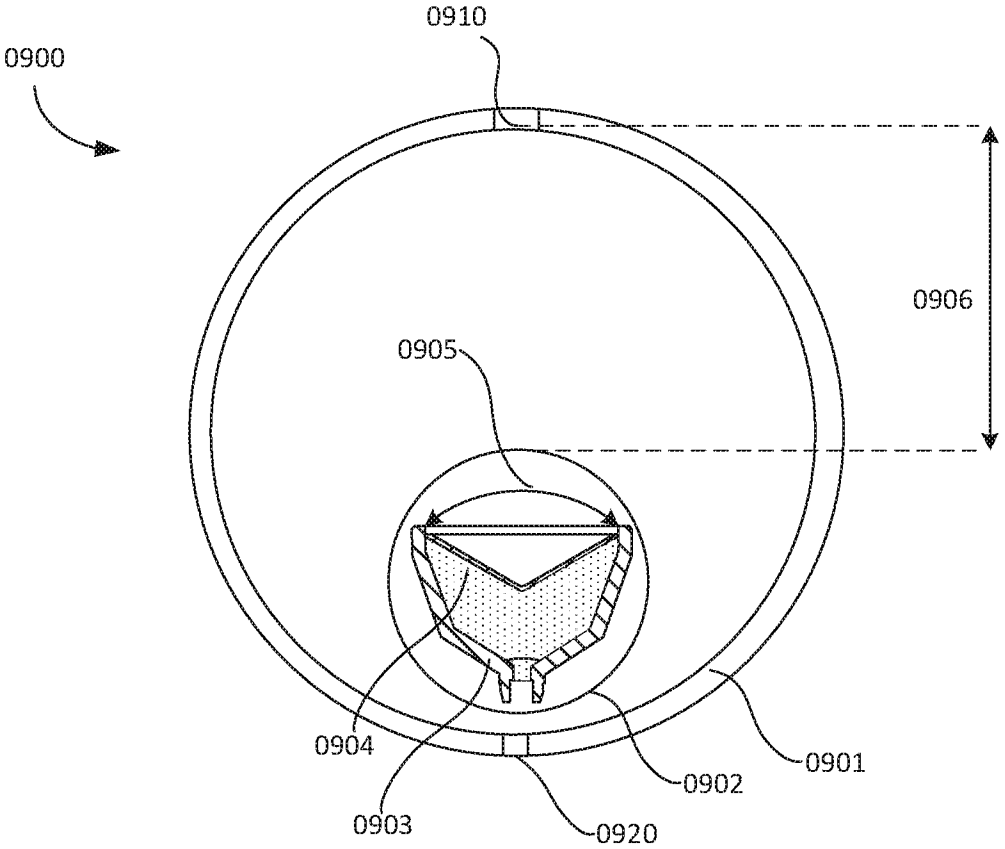
FIG. 9 is an exemplary side view of a shaped charge with a liner in a decentralized perforating gun suitable for use in some preferred embodiments of the invention.

FIG. 9 (0900) generally illustrates a cross section of a perforating gun (0902) having a shaped charge (0903) with a liner (0904) and deployed in a well casing (0901). The liner may be designed with a subtended angle (0905). FIG.

9 (0900) also illustrates a water gap (0906) which is defined as the difference in the inside diameter of the casing (0901) and the outside diameter of the perforating gun (0902). A ratio (EHD ratio) of the diameter of the entrance hole of the top (0910) to the entrance hole of the bottom (0920) can be controlled by varying the subtended angle and aspect ratio of the liner (0904). According to a preferred exemplary embodiment, the EHD ratio is less than 1 for a subtended angle of the liner between 90° and 100°. According to another preferred exemplary embodiment, the EHD ratio is almost equal to 1 for a subtended angle of the liner between 100° and 110°. According to yet another preferred exemplary embodiment, the EHD ratio is greater than 1 for a subtended angle of the liner greater than 110°. According to a preferred exemplary embodiment, the subtended angle of the liner is between 90° and 120°. According to a more preferred exemplary embodiment, the subtended angle of the liner is between 100° and 120°. According to a most preferred exemplary embodiment, the subtended angle of the liner is between 108° and 112°. A subtended angle of 1100 may result in an EHD ratio of 1.

TABLE 1.0

| Charge | Gun O.D. (in.) | Explosive Weight (g) | Shot Density (spf) Phasing | Entry Hole (in.) | Rock Penetration (in.) | API 19B Targeted Pipe | EHD Variation Decentralized |
|---|---|---|---|---|---|---|---|
| 0.30 EHD | 3⅛ | 16 | 6 spf 60 | 0.30 | 7 | 5½ in. OD, 23# P-110 | 3.8% |
| 0.35 EHD | 3⅛ | 20 | 6 spf 60 | 0.35 | 7 | 5½ in. OD, 23# P-110 | 3.0% |
| 0.40 EHD | 3⅛ | 23 | 6 spf 60 | 0.40 | 7 | 5½ in. OD, 23# P-110 | 3.8% |

Figure 10:
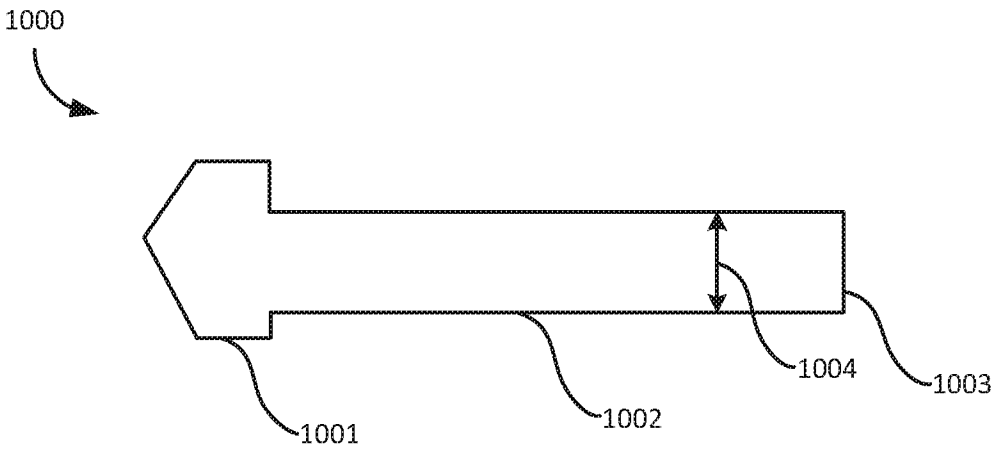
FIG. 10 is an illustration of a jet created by an exemplary shaped charge according to a preferred embodiment of the present invention.

FIG. 10 (1000) generally illustrates a shape of an exemplary jet created by an exemplary shaped charge for use in a perforating gun, the charge comprising a case, a liner positioned within the case, and an explosive filled between the case and the liner. The liner may be shaped with a subtended angle about an apex of the liner, a radius, and an aspect ratio such that the explosive forms a constant jet when exploded. The jet (1000) further comprising a tip end (1001), a tail end (1003), and an extended portion (1002) positioned between the tail end and the tip end. A diameter (1004) of the extended portion is substantially constant from about the tip end to about the tail end. The diameter of an entrance hole diameter created by the jet (1000) is substantially constant and unaffected with changes in design and environmental factors. The extended portion (1002) in the jet (1000) is unannihilated in a water gap when the jet travels through a water gap in a casing. The water gap may be similar to the water gap (0906) illustrated in FIG. 9. The perforating gun may centralized in the casing. The perforating gun may be decentralized in the casing as shown in FIG. 9. The velocity of the tip end may be slightly greater than a velocity of the tail end so that the extended portion is substantially not stretched and therefore maintaining a constant diameter after entry into a hydrocarbon formation until the tip end enters the formation. Additionally, the extended portion is substantially not stretched and maintain a constant diameter before entry into a hydrocarbon formation until the tip end enters the formation. According to a preferred exemplary embodiment the diameter of the jet ranges from 0.15 to 0.75 inches. According to another preferred exemplary embodiment a variation of the diameter of the jet is less than 5%. Constant EHD charges are uniquely designed and engineered to form a constant diameter (1004) fully developed jet. The formation of the jet occurs in the charge case and near the inside wall of the gun carrier behind the scallop/spotface. The diameter of the jet in the initial (jet formation) region or tip end (1001) may be larger than the diameter after it has been fully developed. The holes in the carrier and the casing are formed by different parts of the perforating jet. Different parts of the jets have different diameters. The hole in the gun carrier may be formed during the jet formation process and is comparatively larger than the hole formed in the casing by the fully developed jet. The hole size in the carrier may be 65% larger than the hole size in the casing. The hole size in the gun typically has no relation to the hole size in the casing. This phenomenon is expected and is indicative of proper function.

Preferred Exemplary Flowchart Embodiment of a Stage Perforation Method (1100)

Figure 11:
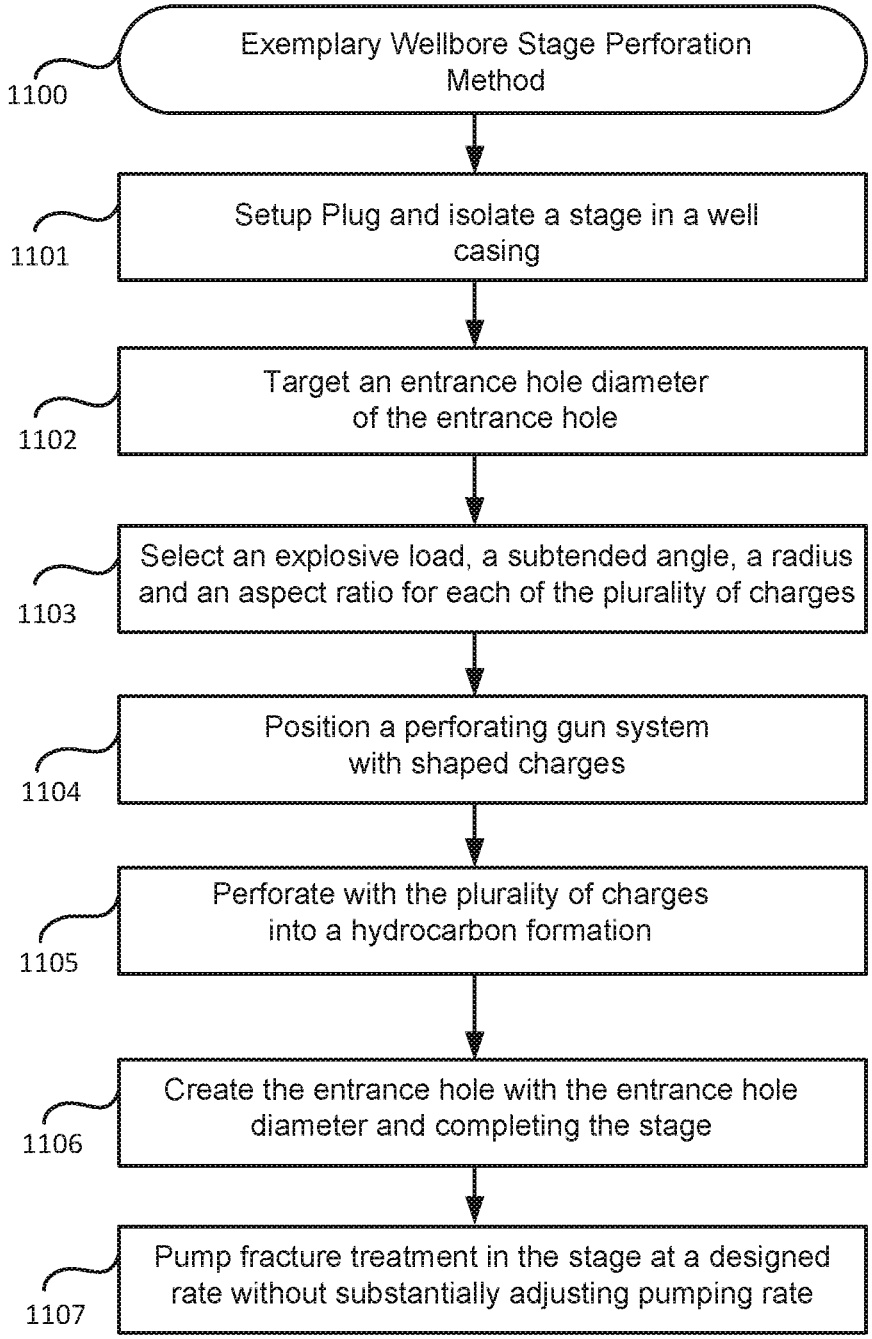
FIG. 11 is a detailed flowchart of a stage perforation method in conjunction with exemplary shaped charges according to some preferred embodiments.

As generally seen in the flow chart of FIG. 11 (1100), a preferred exemplary wellbore perforation method with a plurality of exemplary shaped charges; each of the plurality of charges configured to create an entrance hole in the casing; each of the plurality of charges are configured with liner having a subtended angle about an apex of the liner; the subtended angle of the liner ranges from 100° to 120°; a variation of diameters of entrance holes created with the plurality of charges is configured to be less than 7.5% and the variation unaffected by design and environmental variables. The method may be generally described in terms of the following steps:

(1) Setting up a plug and isolating a stage (1101);

(2) Targeting an entrance hole diameter of the entrance hole (1102); Entrance hole diameters in the range of 0.15 to 0.75 inches may be targeted.

(3) Selecting an explosive load, a subtended angle, a radius and an aspect ratio for each of the plurality of charges (1103);

The explosive load may be selected to create the targeted hole size. For example as illustrated in Table 1.0, explosive weights of 16 g, 20 g and 23 g create entrance holes with diameters of 0.30 inches, 0.35 inches and 0.40 inches respectively. Other explosive weights may be chosen to create EHD's from 0.15 to 0.75 inches. The subtended angle of the liner may be selected to create a constant diameter jet which in turn creates a constant diameter, length and width of the perforation tunnel. A constant diameter jet such as FIG. 10 (1000) enables a substantially constant diameter entrance hole on the top and bottom of the casing irrespective of the water gap such as FIG. 9 (0906).

(4) Positioning the system along with the plurality of charges in the well casing (1104);

(5) Perforating with the plurality of charges into a hydrocarbon formation (1105);

(6) Creating the entrance hole with the entrance hole diameter and completing the stage (1106); and The variation may be defined as ((Max. Diameter−Min. Diameter/Avg. Diameter)*100). According to a preferred exemplary embodiment, the variation of the entrance hole diameters is less than 7.5% irrespective of the design and environmental factors. According to a more preferred exemplary embodiment, the variation of the entrance hole diameters is less than 5%. In addition, the variation of the length of the perforation tunnel may be less than 20%.

(7) Pumping fracture treatment in said stage at a designed rate without substantially adjusting pumping rate (1107).

A substantially constant (variation less than 7.5%) entrance hole diameter with a substantially constant penetration length of the perforation tunnel enables a fracture treatment at a designed injection rate without an operator adjusting the pumping rate. The lower variation keeps the pressure within 100% of the designed pressure as opposed to 500% for perforations created with conventional deep penetration charges.

Preferred Exemplary Flowchart Embodiment of Limited Entry Perforation (1200)

Limited entry perforation provides an excellent means of diverting fracturing treatments over several zones of interest at a given injection rate. In a given hydrocarbon formation multiple fractures are not efficient as they create tortuous paths for the fracturing fluid and therefore result in a loss of pressure and energy. In a given wellbore, it is more efficient to isolate more zones with clusters comprising less shaped charges as compared to less zones with clusters comprising more shaped charges. For example, at a pressure of 10000 psi, to achieve 2 barrels per minute flow rate per perforation tunnel, 12 to 20 zones and 12-15 clusters each with 15-20 shaped charges are used currently. Instead, to achieve the same flow rate, a more efficient method and system is isolating 80 zones with more clusters and using 2 or 4 shaped charges per cluster while perforating. Conventional perforating systems use 12-15 shaped charges per cluster while perforating in a 60/90/120 degrees or a 0/180 degrees phasing. This creates multiple fracture planes that are not efficient for fracturing treatment as the fracturing fluid follows a tortuous path while leaking energy/pressure intended for each fracture. Creating minimum number of multiple fractures near the wellbore is desired so that energy is primarily focused on the preferred fracturing plane than leaking off or losing energy to undesired fractures. 60 to 80 clusters with 2 or 4 charges per cluster may be used in a wellbore completion to achieve maximum efficiency during oil and gas production.

Figure 12:
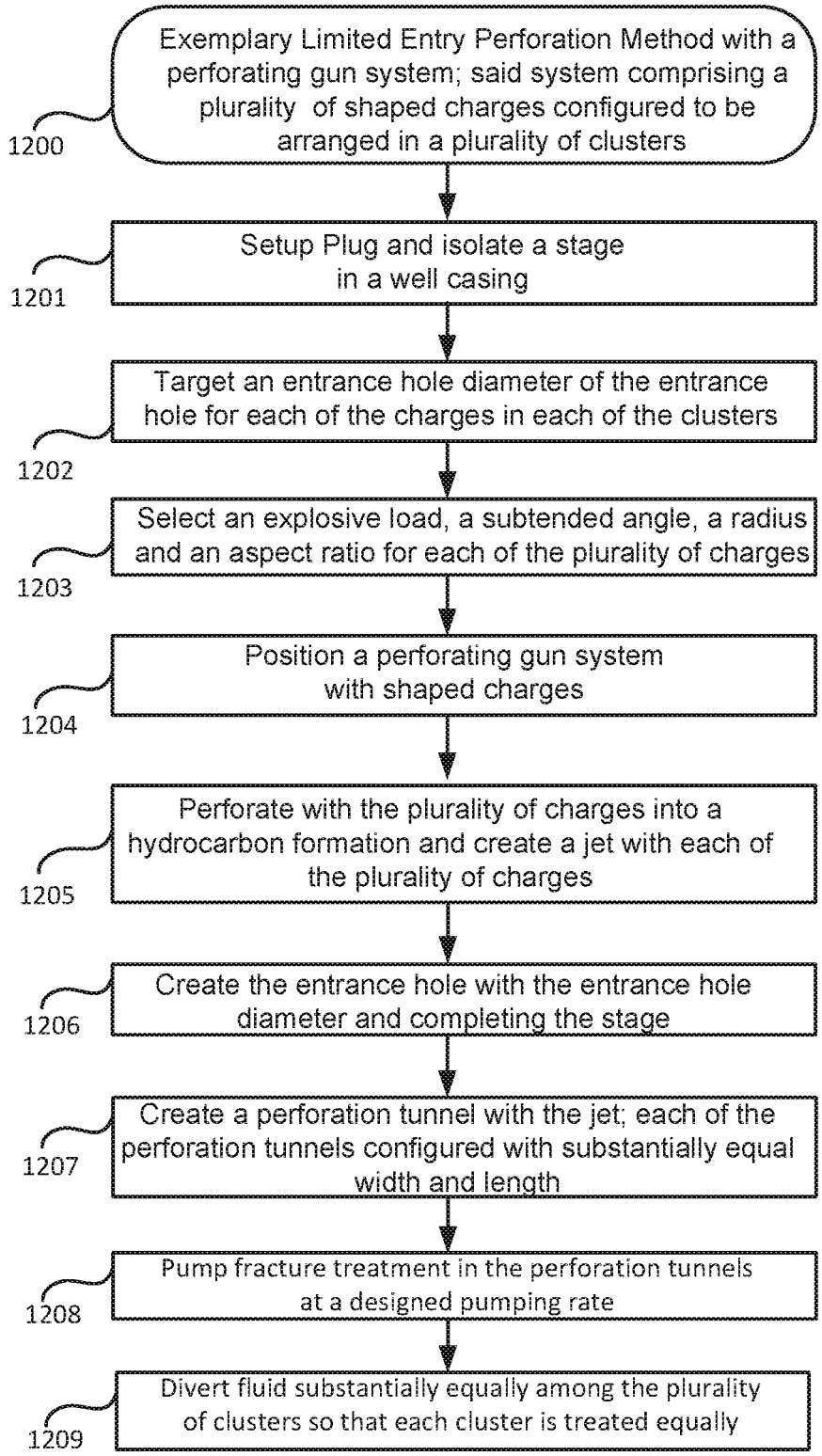
FIG. 12 is a detailed flowchart of a limited entry method for treating a stage in a well casing in conjunction with exemplary shaped charges according to some preferred embodiments.

As generally seen in the flow chart of FIG. 12 (1200), a preferred exemplary wellbore perforation method with an exemplary system; the system comprising a plurality of shaped charges configured to be arranged in a plurality of clusters, each of the plurality of charges is configured to create an entrance hole in the casing; each of the plurality of charges are configured with liner having a subtended angle about an apex of the liner; the subtended angle of the liner ranges from 100° to 120°; a variation of diameters of entrance holes created with the plurality of charges within each of the plurality of clusters is configured to be less than 7.5% and the variation unaffected by design and environmental variables. According to a preferred exemplary embodiment a number of clusters in each stage ranges from 2 to 10. The method may be generally described in terms of the following steps:

(1) Setting up a plug and isolating a stage (1201);

When a long lateral casing is installed, friction losses within the pipe requires a larger entrance hole at the toe end of the stage. Current stages are designed for more than the required entrance hole. For example, a 0.45 EHD hole may be designed when a 0.35 EHD is required due to unpredictability of the EHD. An exemplary embodiment with a low variability charges does not require over design of the charges for EHD to overcome friction losses in a casing.

(2) Determining a target diameter for the entrance hole (1202);

Entrance hole diameters in the range of 0.15 to 0.75 inches may be targeted. According to a preferred exemplary embodiment the diameters of the entrance holes in all of the clusters is substantially equal. According to another preferred exemplary embodiment the target entrance hole diameter in one of the plurality of clusters and another said plurality of clusters is unequal. For example, if there are 3 clusters in a stage, the target diameters of the entrance holes created by all the charges in each cluster may be 0.30 inches, 0.35 inches and 0.45 inches starting from uphole to downhole. This step up diameter arrangement of different EHD charges from uphole to downhole enables fluid to be limited in the smallest hole and diverted to the next biggest hole and further diverted to the largest hole. In the above example, fluid is limited in the cluster with the 0.30 inch hole and then diverted to 0.35 inch hole and further diverted to 0.40 inch hole. The predictability and low variability of the entrance holes enable the pumping rate to be substantially (something missing) at the designed pump rate. According to a preferred exemplary embodiment each of the clusters is fractured at a fracture pressure; a variation of the fracture pressure for all of the clusters is configured to be less than 500 psi. For example, if the designed pressure for a given injection rate is 5000 psi, the variation of pressure is less than 500 psi or a range of 4500 to 5500 psi.

(3) Selecting an explosive load, a subtended angle, a radius and an aspect ratio for each of the plurality of charges (1203);

The explosive load may be selected to create the targeted hole size. For example as illustrated in Table 1.0, explosive weights of 16 g, 20 g and 23 g create entrance holes with diameters of 0.30 inches, 0.35 inches and 0.40 inches respectively. Other explosive weights may be chosen to create EHD's from 0.15 to 0.75 inches. The subtended angle of the liner may be selected to create a constant diameter jet which in turn creates a constant diameter, length and width of the perforation tunnel. A constant diameter jet such as FIG. 10 (1000) enables a substantially constant diameter entrance hole on the top and bottom of the casing irrespective of the water gap such as FIG. 9 (0906).

(4) Positioning the system along with the plurality of charges in the well casing (1204);

According to a preferred exemplary embodiment a target entrance hole diameter of an entrance hole created in a toe end cluster and a target entrance hole diameter of an entrance hole created in a another cluster positioned upstream of the toe end cluster are selected such that a friction loss of the casing during the pumping step (8) is offset. For example in aforementioned step (2), the toe end cluster may have an EHD of 0.45 inches and the heel end cluster may have an EHD of 0.35 inches and the friction loss of the casing may be offset by the difference of the predictable EHD of the toe end and heel end clusters.

The pressure drop and pumping rate of the fluid may be kept with a 1000 psi range while also accounting for the friction loss.

(5) Perforating with the plurality of charges into a hydrocarbon formation and creating a jet with each of the plurality of charges (1205);

(6) Creating the entrance hole with the target entrance hole diameter with the jet (1206);

(7) Creating a perforation tunnel with the jet; each of the perforation tunnels configured with substantially equal width and length (1207);

According to a preferred exemplary embodiment a variation of perforation length with the plurality of charges within each of the plurality of clusters is configured to be less than 20%. Similarly, a variation of perforation width with the plurality of charges within each of the plurality of clusters is configured to be less than 20%.

(8) Pumping fracture treatment in the stage at a designed rate without substantially adjusting pumping rate (1208); and (9) Diverting fluid substantially equally among the plurality of clusters (1209).

According to a preferred exemplary embodiment diverters are pumped along with the pumping fluid in the pumping step (8). The diverters may be selected from a group comprising: solid diverters, chemical diverters, or ball sealers. For a limited entry treatment, it is important that each of the clusters participate equally in the fracture treatment. Fluid is pumped at a high rate and the number of cluster are limited so that the amount of fluid in each of the clusters is limited. According to a preferred exemplary embodiment, a substantially constant entrance hole along with diverters enables fluid to be limited and equally diverted among the clusters. According to another preferred exemplary embodiment a number of the plurality of charges in each of the clusters is further based on the target entrance hole diameter. For example, if the number of clusters is 10 the target diameter may be 0.30 inches to achieve maximum fracture efficiency. Alternatively, the number of clusters may be 5 the target diameter may be 0.45 inches to achieve a similar maximum fracture efficiency. The design of the EHD, the number of charges per cluster, the number of clusters per stage and the number of stages per zone can be factored in with the predictable variation of entrance hole diameters to achieve maximum perforation and fracture efficiency.

Preferred Exemplary Flowchart Embodiment of a Step Down Method (1300)

Step-down test analysis is done by plotting the pressure/rate data points with the same time since the last rate change on a pressure-rate plot, and matching the pressure loss model to these points. On the basis of the model, the perforation and tortuosity components of the pressure loss are calculated, and the defining parameters are also estimated. From the equations aforementioned, one of key contributors to the perforation pressure loss is the diameter of the perforation hole. A large variation in the diameter of the perforation causes a large variation in the perforation loss component. The exemplary charges illustrated in FIG. 5A (0500) or FIG. 5B (0540) create EHD's within a variation of 7.5% such that overall pressure loss is attributable to the tortuosity and provides a measure of the tortuosity near the wellbore. When a tortuosity of the near wellbore is modelled, a stage may be designed with more accuracy and predictability. For step-down tests, it is essential to keep as many variables controlled as possible, so that the pressure response during the rate changes is due largely to perforations and tortuosity, and not some other factors. However, if the pressure variation due to perforations is controlled with exemplary charges illustrated in FIG. 5A (0500) or FIG. 5B (0540), the pressure response during the rate changes is mainly due to tortuosity.

Figure 13:
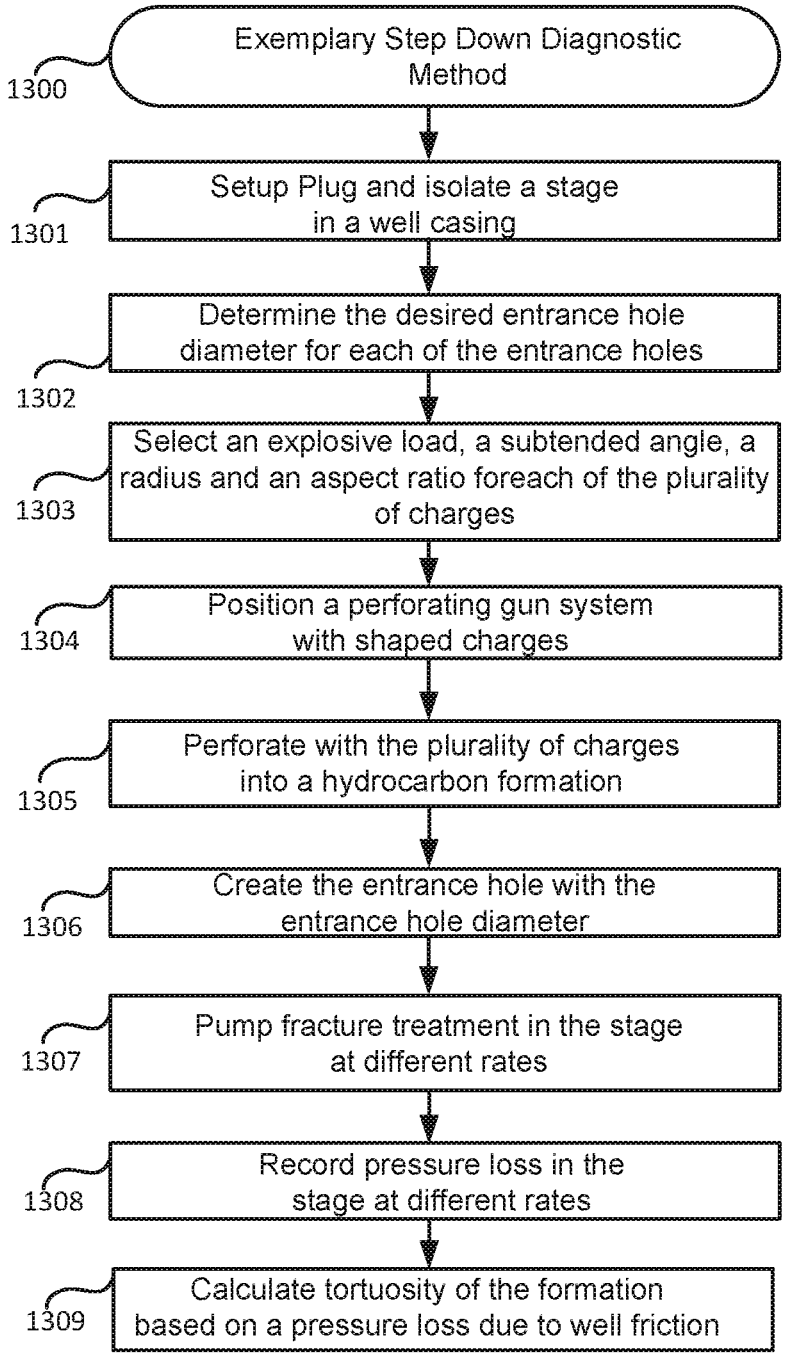
FIG. 13 is a detailed flowchart of a step down method for determining tortuosity in a hydrocarbon formation in conjunction with exemplary shaped charges according to some preferred embodiments.

As generally seen in the flow chart of FIG. 13 (1300), a step down method for determining tortuosity in a hydrocarbon formation, in conjunction with a perforating gun system deployed in a well casing; the system comprising a plurality of shaped charges wherein, each of the plurality of charges are configured to create an entrance hole in a casing with a desired entrance hole diameter; each of the plurality of charges are configured with liner having a subtended angle about an apex of the liner; the subtended angle of the liner ranges from 100° to 120°; and a variation of diameters between each of the entrance hole is less than 7.5% and the variation unaffected by design and environmental variables. The method may be generally described in terms of the following steps:

(1) Setting up a plug and isolating a stage (1301);

(2) Targeting an entrance hole diameter of the entrance hole (1302);

Entrance hole diameters in the range of 0.15 to 0.75 inches may be targeted.

(3) Selecting an explosive load, a subtended angle, a radius and an aspect ratio for each of the plurality of charges (1303);

(4) Positioning the system along with the plurality of charges in the well casing (1304);

(5) Perforating with the plurality of charges into a hydrocarbon formation (1305);

(6) Creating the entrance hole with the entrance hole diameter and completing the stage (1306);

(7) Pumping treatment fluid at different fluid rates into the perforation tunnel in the stage (1307);

(8) Recording pressure at each of the fluid rates (1308); and (9) Calculating tortuosity of the formation based on a pressure loss due to well friction (1309).

System Summary

The present invention system anticipates a wide variety of variations in the basic theme of a shaped charge for use in a perforating gun, the charge comprising a case, a liner positioned within the case, and an explosive filled within the liner; the liner shape configured with a subtended angle about an apex of the liner, a radius, and an aspect ratio such that a jet formed with the explosive creates an entrance hole in a well casing; the subtended angle of the liner ranges from 100° to 120°; the jet creates a perforation tunnel in a hydrocarbon formation; wherein a diameter of the jet, a diameter of the entrance hole, and a width and length of the perforation tunnel are substantially constant and unaffected with changes in design and environmental factors.

An alternate invention system anticipates a wide variety of variations in the basic theme of a shaped charge for use in a perforating gun, the charge comprising a case, a liner positioned within the case, and an explosive filled within the liner; the liner shape configured with a subtended angle about an apex of the liner, a radius, and an aspect ratio such that a jet formed with the explosive creates an entrance hole in a well casing; the jet creates a perforation tunnel in a hydrocarbon formation; wherein a diameter of the jet, a diameter of the entrance hole, and a width and length of the perforation tunnel are substantially constant and unaffected with changes in design and environmental factors.

This general system summary may be augmented by the various elements described herein to produce a wide variety of invention embodiments consistent with this overall design description.

Method Summary

The present invention method anticipates a wide variety of variations in the basic theme of implementation, but can be generalized as stage perforation method using a perforating gun system in a wellbore casing wherein the system comprises a plurality of shaped charges; each of the plurality of charges are configured to create an entrance hole in the casing; a range of diameters of entrance holes created with the plurality of charges is configured to be less than 7.5% and the variation unaffected by design and environmental variables;

wherein the method comprises the steps of:

(1) setting up a plug and isolating a stage;

(2) targeting an entrance hole diameter of the entrance hole;

(3) selecting an explosive load, a subtended angle, a radius and an aspect ratio for each of the plurality of charges;

(4) positioning the system along with the plurality of charges in the well casing;

(5) perforating with the plurality of charges into a hydrocarbon formation;

(6) creating the entrance hole with the entrance hole diameter and completing the stage; and (7) pumping fracture treatment in the stage at a designed rate without substantially adjusting pumping rate.

This general method summary may be augmented by the various elements described herein to produce a wide variety of invention embodiments consistent with this overall design description.

System/Method Variations

The present invention anticipates a wide variety of variations in the basic theme of oil and gas extraction. The examples presented previously do not represent the entire scope of possible usages. They are meant to cite a few of the almost limitless possibilities.

This basic system and method may be augmented with a variety of ancillary embodiments, including but not limited to:

An embodiment wherein diameter of the jet, a diameter of the entrance hole, and a width and length of the perforation tunnel are substantially constant and unaffected by design and environmental factors; the design and environmental factors selected from a group comprising: casing diameter, gun diameter, a thickness of the well casing, composition of the well casing, position of the charge in the perforating gun, position of the perforating gun in the well casing, a water gap in the well casing, or type of the hydrocarbon formation.

An embodiment wherein a thickness of the liner is substantially constant.

An embodiment wherein the thickness of the liner ranges from 0.01 to 0.2 inches.

An embodiment wherein the aspect ratio of the liner ranges from 2 to 5 inches.

An embodiment wherein the radius of the liner ranges from 0.01 to 0.5 inches.

An embodiment wherein the diameter of the entrance hole in the well casing ranges from 0.15 to 0.75 inches.

An embodiment wherein a variation of the diameter of the entrance hole in the well casing is less than 7.5% inches.

An embodiment wherein the width of the perforation tunnel in the hydrocarbon formation ranges from 0.15 to 1 inches.

An embodiment wherein a variation of the width of the perforation tunnel in the hydrocarbon formation ranges is less than 5%.

An embodiment wherein the length of the perforation tunnel in the hydrocarbon formation ranges from 1 to 20 inches.

An embodiment wherein a variation of the length of the perforation tunnel in the hydrocarbon formation is less than 20%.

An embodiment wherein the diameter of the jet ranges from 0.15 to 0.75 inches.

An embodiment wherein a variation of the diameter of the jet is less than 5%.

An embodiment wherein the thickness of the well casing ranges from 0.20 to 0.75 inches.

An embodiment wherein the diameter of the well casing ranges from 4 to 6 inches.

An embodiment wherein the diameter of the gun ranges from 1 to 7 inches.

An embodiment wherein the position of the charge in the perforating gun is oriented in an upward direction.

An embodiment wherein the position of the charge in the perforating gun is oriented in a downward direction.

An embodiment wherein the position of the perforating gun in the well casing is centralized.

An embodiment wherein the position of the perforating gun in the well casing is decentralized.

An embodiment wherein the thickness of the water gap ranges from 0.15 to 2.5 inches.

An embodiment wherein the type of the hydrocarbon formation is selected from a group comprising: shale, carbonate, sandstone or clay.

An embodiment wherein the charge is selected from a group comprising: reactive, or conventional charges.

One skilled in the art will recognize that other embodiments are possible based on combinations of elements taught within the above invention description.

CONCLUSION

A shaped charge for use in a perforating gun has been disclosed. The charge comprises a case, a liner positioned within the case, and an explosive filled within the case. The liner is shaped with a subtended angle about an apex, a radius, and an aspect ratio such that a jet formed with the explosive creates an entrance hole in a well casing. The jet creates a perforation tunnel in a hydrocarbon formation, wherein a diameter of the jet, a diameter of the entrance hole diameter, and a width and length of the perforation tunnel are substantially constant and unaffected with changes in design and environmental factors such as a thickness and composition of the well casing, position of the charge in the perforating gun, position of the perforating gun in the well casing, a water gap in the wellbore casing, and type of the hydrocarbon formation.

What is claimed is:

1. A shaped charge for use in a perforating gun, said charge comprising a case, a liner positioned within said case, and an explosive filled within said liner; said liner shape configured with a subtended angle about an apex of said liner such that a jet formed with said explosive creates an entrance hole in a well casing: said liner having an exterior surface, said exterior surface substantially straight and conically tapered to form said apex; said subtended angle of said liner ranges from 100° to 120°, said jet creates a perforation tunnel in a hydrocarbon formation; wherein a diameter of said entrance hole is substantially equal to a diameter of a second entrance hole created by a second charge.

2. The shaped charge of claim 1 wherein a thickness of said liner is substantially constant.

3. The shaped charge of claim 2 wherein said thickness of said liner ranges from 0.01 to 0.2 inches.

4. The shaped charge of claim 2 wherein a variation of said diameter of said entrance hole in said well casing is less than 7.5%.

5. The shaped charge of claim 1 wherein said radius of said liner ranges from 0.01 to 0.5 inches.

6. The shaped charge of claim 1 wherein said diameter of said entrance hole in said well casing ranges from 0.15 to 0.75 inches.

7. The shaped charge of claim 1 wherein a width of said perforation tunnel in said hydrocarbon formation ranges from 0.15 to 1 inches.

8. The shaped charge of claim 1 wherein a variation of a width of said perforation tunnel in said hydrocarbon formation ranges is less than 5%.

9. The shaped charge of claim 1 wherein a length of said perforation tunnel in said hydrocarbon formation ranges from 1 to 20 inches.

10. The shaped charge of claim 1 wherein a variation of a length of said perforation tunnel in said hydrocarbon formation is less than 20%.

11. The shaped charge of claim 1 wherein a diameter of said jet ranges from 0.15 to 0.75 inches.

12. The shaped charge of claim 1 wherein a variation of a diameter of said jet is less than 5%.

13. The shaped charge of claim 1 wherein a thickness of said well casing ranges from 0.20 to 0.75 inches.

14. The shaped charge of claim 1 wherein a diameter of said well casing ranges from 3 to 12 inches.

15. The shaped charge of claim 1 wherein a diameter of said gun ranges from 1 to 7 inches.

16. The shaped charge of claim 1 wherein said charge in said perforating gun is oriented in an upward direction.

17. The shaped charge of claim 1 wherein said charge in said perforating gun is oriented in a downward direction.

18. The shaped charge of claim 1 wherein said perforating gun in said well casing is centralized.

19. The shaped charge of claim 1 wherein said perforating gun in said well casing is decentralized.

20. The shaped charge of claim 1 wherein a thickness of a water gap in said well casing ranges from 0.15 to 2.5 inches.

21. The shaped charge of claim 1 wherein said type of said hydrocarbon formation is selected from a group consisting of: shale, carbonate, sandstone and clay.

22. The shaped charge of claim 1 wherein said charge is selected from a group consisting of: reactive, and conventional charges.

23. The shaped charge of claim 1 wherein said second charge is located in a second perforating gun.

24. The shaped charge of claim 1 wherein said second perforating gun is located in same stage as said perforating gun.

25. The shaped charge of claim 1 wherein said second perforating gun is located in a different stage as said perforating gun.

26. The shaped charge of claim 1 wherein said second charge is located in said perforating gun.

27. A shaped charge for use in a perforating gun, said charge comprising a case, a liner positioned within said case, and an explosive filled within said liner; said liner shape configured with a subtended angle about an apex of said liner and an aspect ratio such that a jet formed with said explosive creates an entrance hole in a well casing; said subtended angle of said liner ranges from 100° to 120°; said liner having an exterior surface, said exterior surface substantially conical proximate said apex; said jet creates a perforation tunnel in a hydrocarbon formation; wherein a diameter of said jet is substantially equal to a diameter of a second jet created by a second shaped charge, a diameter of said entrance hole is substantially equal to a diameter of a second entrance hole created by said second charge, and a width and length of said perforation tunnel are substantially constant equal to a width and length of a second perforation tunnel created by said second charge in said second perforating gun.

28. A shaped charge for use in a perforating gun, said charge comprising a case, a liner positioned within said case, and an explosive filled within said liner; said liner shape configured with a subtended angle about an apex of said liner-such that a jet formed with said explosive creates an entrance hole in a well casing; said liner having an exterior surface, said exterior surface substantially straight and conically tapered to form said apex; said subtended angle of said liner ranges from 100° to 120°; said jet creates a perforation tunnel in a hydrocarbon formation; wherein a width and length of said perforation tunnel are substantially equal to a width and length of a second perforation tunnel created by said second charge.

* * * * *